US011713162B2

(12) United States Patent
Ramponi et al.

(10) Patent No.: US 11,713,162 B2
(45) Date of Patent: Aug. 1, 2023

(54) CONTAINER

(71) Applicant: Mote LLC, Newport, RI (US)

(72) Inventors: Stephen Ramponi, Newport, RI (US); Anthony J. Longo, Jr., Jamestown, RI (US)

(73) Assignee: Mote LLC, Newport, RI (US)

( * ) Notice: Subject to any disclaimer, the term of this patent is extended or adjusted under 35 U.S.C. 154(b) by 0 days.

(21) Appl. No.: 17/023,262

(22) Filed: Sep. 16, 2020

(65) Prior Publication Data

US 2021/0094730 A1 Apr. 1, 2021

Related U.S. Application Data

(60) Provisional application No. 62/901,764, filed on Sep. 17, 2019.

(51) Int. Cl.

| | |
|---|---|
| ***B65D 25/06*** | (2006.01) |
| ***A61J 7/00*** | (2006.01) |
| ***A45C 11/00*** | (2006.01) |
| ***B65D 6/06*** | (2006.01) |
| ***B65D 43/16*** | (2006.01) |
| ***B65D 25/04*** | (2006.01) |
| ***A45C 15/00*** | (2006.01) |
| ***B65D 83/04*** | (2006.01) |

(52) U.S. Cl.

CPC ..... *B65D 25/06* (2013.01); *A45C 15/00* (2013.01); *A61J 7/0069* (2013.01); *B65D 11/12* (2013.01); *B65D 25/04* (2013.01); *B65D 43/163* (2013.01); *B65D 83/04* (2013.01); *A45C 11/008* (2013.01); *A45C 2011/007* (2013.01); *B65D 43/162* (2013.01); *B65D 43/164* (2013.01)

(58) Field of Classification Search

CPC ..... B65D 1/36; B65D 2585/56; B65D 83/04; A61J 1/03; A61J 7/0069; A45C 15/00; A45C 2011/007

USPC ..... 206/533, 538; 220/524

See application file for complete search history.

(56) References Cited

U.S. PATENT DOCUMENTS

| | | | | | |
|---|---|---|---|---|---|
| 2,019,235 | A | * | 10/1935 | Parkin | A24F 15/18 220/DIG. 26 |
| 2,789,612 | A | * | 4/1957 | Rising | A45C 1/08 150/136 |
| D227,552 | S | | 7/1973 | Bridges | |
| 5,004,106 | A | * | 4/1991 | Blumstock | A45C 11/24 206/581 |
| 5,806,670 | A | * | 9/1998 | Harlan | A61J 1/03 220/523 |
| D399,346 | S | | 10/1998 | Saari | |

(Continued)

OTHER PUBLICATIONS

Abu-Geras et al, Accuracy of tablet splitting and liquid measurements: an examination of who, what and how, 2017, Journal of Pharmacy and Pharmacology, Royal Pharmaceutical Society, 69, pp. 605 (Year: 2017).*

(Continued)

*Primary Examiner* — Mollie Impink

(74) *Attorney, Agent, or Firm* — Wolf, Greenfield & Sacks, P.C.

(57) ABSTRACT

A container for holding personal items is disclosed. The container includes a body with one or more dividers that at least in part define one or more compartments for holding personal items. The container includes one or more covers attached to the container body to cover and secure the personal items in the compartments. Each cover may form at least a top of a compartment. The container is less than about 8 mm in height.

20 Claims, 29 Drawing Sheets

(56) References Cited

U.S. PATENT DOCUMENTS

| | | | | |
|---|---|---|---|---|
| D418,288 | S | 1/2000 | Priebe | |
| D450,455 | S | 11/2001 | Dembicks | |
| D466,801 | S | 12/2002 | Holland | |
| 6,516,950 | B1 | 2/2003 | Robertson | |
| 6,648,143 | B2 | 11/2003 | Robertson | |
| D528,782 | S | 9/2006 | Oas | |
| D541,039 | S | 4/2007 | Stugelmeyer | |
| 7,434,692 | B2 | 10/2008 | Ginsberg et al. | |
| 7,631,764 | B2 | 12/2009 | Ginsberg et al. | |
| 8,381,911 | B2 | 2/2013 | Buchner et al. | |
| 9,205,950 | B2 * | 12/2015 | Roesler | B65D 21/0204 |
| D756,804 | S | 5/2016 | Gross | |
| D812,368 | S | 3/2018 | Noble | |
| D897,665 | S | 10/2020 | Guo et al. | |
| D898,346 | S | 10/2020 | Lee | |
| D909,744 | S | 2/2021 | Guo et al. | |
| 11,123,263 | B2 * | 9/2021 | Lee | A61J 7/0084 |
| D939,203 | S | 12/2021 | Lee | |
| D943,267 | S | 2/2022 | Cen | |
| 2003/0043026 | A1 | 3/2003 | Noble et al. | |
| 2003/0205496 | A1 | 11/2003 | Howard et al. | |
| 2005/0045519 | A1 | 3/2005 | Hirsch | |
| 2006/0086641 | A1 | 4/2006 | Priebe et al. | |
| 2008/0202955 | A1 | 8/2008 | Kutsch et al. | |
| 2021/0128405 | A1 | 5/2021 | Lee | |
| 2021/0177698 | A1 | 6/2021 | Lee | |

OTHER PUBLICATIONS https://www.facebook.com/fulFILLcontainer/found on facebook, posted Sep. 4, 2019, screenshot captured and provided in office action allowability notice. (Year: 2019).*

[No Author Listed] No Bag/No Problem. Fulfill Container. https://fulfillcontainer.com, 8 pages [publicly available prior to Sep. 17, 2019; last accessed Jun. 26, 2020].

[No Author Listed] Product Listing for MOAT RFID Credit Card Holder Sleek Modern Aluminum Minimalist Wallet. MOAT. https://www.amazon.com/MOAT-Aluminium-Minimalist-Protecting-travelling/dp/B07KGB5K3Z, 5 pages [ publicly available prior to Sep. 17, 2019; last accessed Jun. 26, 2020].

[No Author Listed] Product Listing for Pivit Weekly AM/PM Pill Box, Portable Travel Pill Organizer. Walmart. https://www.walmart.com/ip/Organizer-Liver-Large-Vitamins-Design-Weekly-Compartments-Medication-Moisture-Proof-Cod-Pack-Oil-Supplements-Pivit-Portable-Travel-2-AM-PM-Pill-7-Day/780483750. Publicly available at least as early as Sep. 27, 2019, 8 pages.

[No Author Listed] Product Listing for Portable 7 Days Pill Box Travel Pill Organizer With Pill Spliter Cutter. Goodgreats.com. https://goodsgreats.com/products/portable-7-days-pill-box-travel-pill-organizer-with-pill-splitter-cutter#1. Publicly available at least as early as Sep. 27, 2019, 1 page.

[No Author Listed] Weekly Pill Organizer 2 Times a Day, first available Aug. 30, 2020, amazon.com [online], [site visited Aug. 25, 2021], Available at internet URL: https://www.amazon.com/dp/B08GZYCCFY (Year: 2020).

Ramponi, mote—Life is an adventure, be ready for Anything!. Kickstarter.com. Jun. 18, 2020. 19 pages. URL: https://www.kickstarter.com/projects/bringmote/.

U.S. Appl. No. 29/707,494, filed Sep. 27, 2019, Ramponi et al.

U.S. Appl. No. 29/728,958, filed Mar. 23, 2020, Ramponi et al.

* cited by examiner

FIG. 19
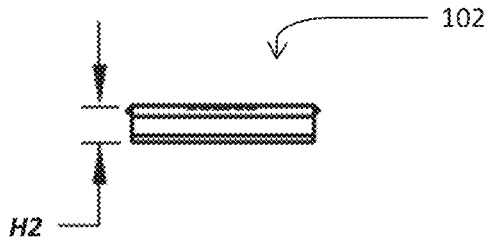
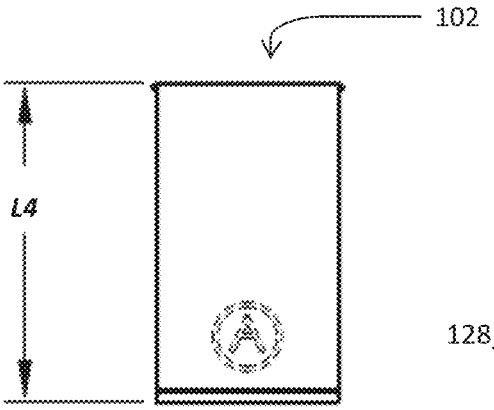
FIG. 17
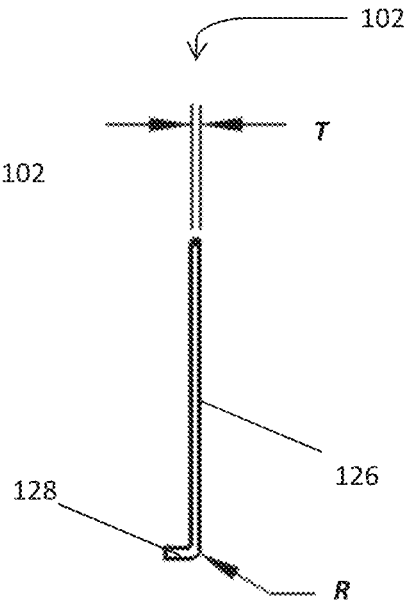
FIG. 18

CONTAINER

RELATED APPLICATIONS

This application claims the benefit under 35 U.S.C. § 119(e) to U.S. Application Ser. No. 62/901,764, entitled "CONTAINER" and filed on Sep. 17, 2019, which is hereby incorporated by reference in its entirety.

FIELD

The disclosed embodiments relate to containers.

BACKGROUND

Containers may be used to hold personal items. For example, containers are used to organize and store pills, wax-based produced, gel-based products, gum-based products, consumer goods, and/or accessories.

SUMMARY

According to one embodiment, a container is disclosed. The container includes a container body having one or more dividers that at least in part define first, second, third, and fourth compartments arranged to hold one or more personal items. The one or more dividers include first and second longitudinal dividers that extends at least part way between a front and a rear of the container body and first and second lateral dividers, wherein the first lateral divider extends between a first side of the body and the first longitudinal divider and the second lateral divider extends between the first and second longitudinal dividers. The container also includes first, second, third, and fourth covers arranged to cover the first, second, third, and fourth compartments, respectively. A height of the container is less than about 8 mm It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 17 is a bottom view of a cover of the container of FIG. 11;

FIG. 18 is a side view of the cover of FIG. 17;

FIG. 19 is a rear view of the cover of FIG. 17;

DETAILED DESCRIPTION

Figure 1:
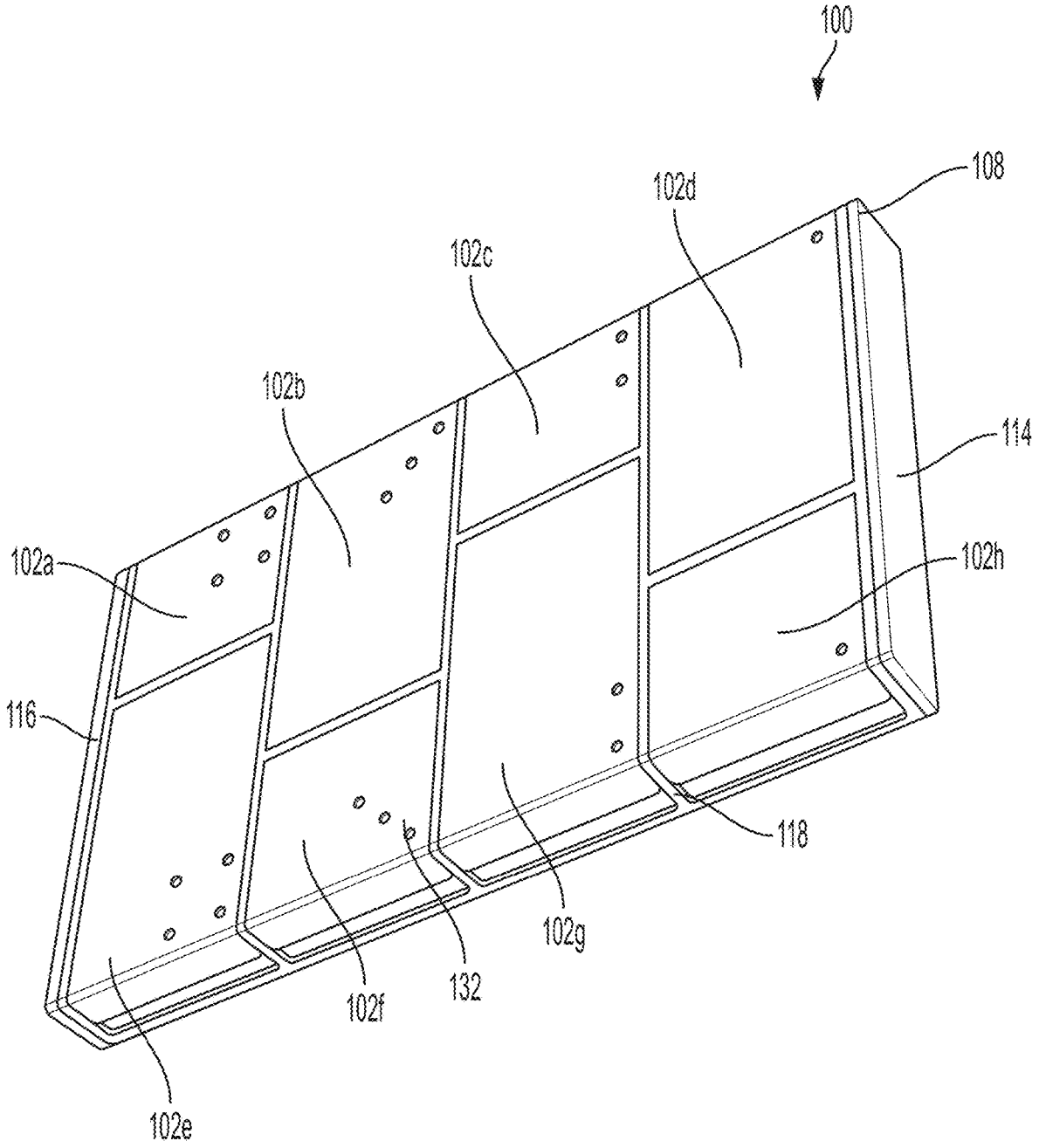
FIG. 1 is a perspective view of a container according to some embodiments.
Figure 2:
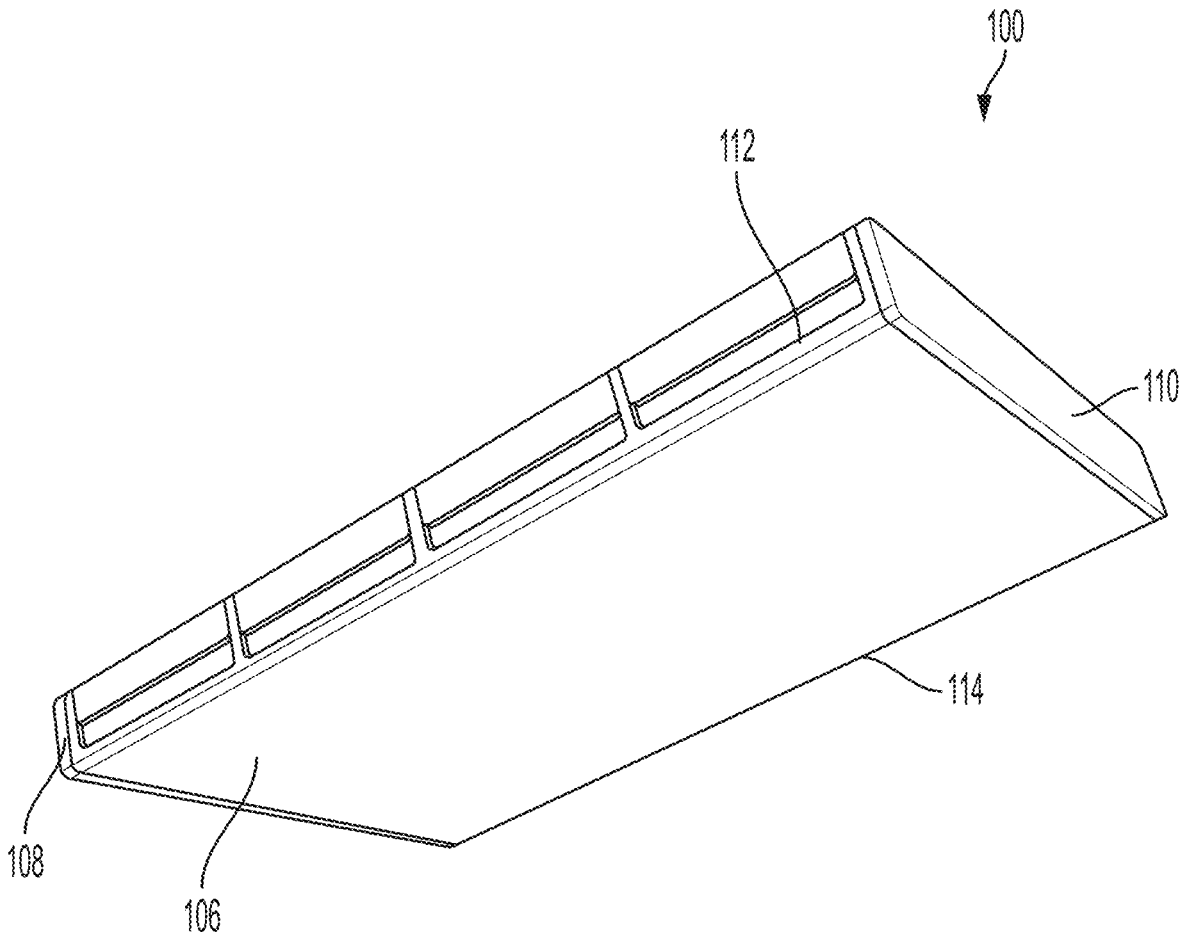
FIG. 2 is bottom perspective view of the container of FIG. 1.

Every day, people carry various personal items with them, including lip balm, keys, gum, medication, supplements, mints, and sunblock, to name a few. Some people carry their personal items in a bag, such as in their briefcase, purse, or fanny pack. Other people may ask a friend or family member to carry their items for them (e.g., in the friend or family member's bag). Unfortunately, if a person does not have a bag to store their items in or does not wish to carry a bag, they must either carry their items in their hands or must carry them in their pockets. This may result in the person (also referred to herein as the user) having overstuffed pockets or having to decide which item(s) to carry if there isn't enough space in their pockets. It also may result in the person forgetting one or more items at home or at work.

The inventors have recognized that advantages may be realized by having a container that is arranged to store and/or organize a user's personal items and also arranged to fit in the user's pocket. For example, in some embodiments, the container may be similar in size to that of a wallet or a mobile phone such that the user may carry the container with personal items in their pocket. As will be appreciated, although the container is shown and described as being carried in the user's pocket, the user also may carry the container by hand or in a bag, if preferred. In some embodiments, the container may be arranged to fit in the user's wallet. For example, the container may be similar in size to a credit card and may be insertable in a slot in the user's wallet.

In some embodiments, as will be described, the container may itself include a wallet portion. For example, the container may include a wallet sheath that is attachable to the container. In such embodiments, the user may simply carry the container instead of separately carrying their wallet and one or more personal items. In some embodiments, the container may include a wallet portion and an attachment for a mobile phone. In some embodiments, the mobile phone may be removably attachable to the container such that the user may store the container (and wallet portion) in their pocket while using the phone. As will be appreciated, the user may keep the container (with the wallet) and phone, in his/her pocket or may carry the container, with the attached wallet, by hand while carrying the mobile phone.

In some embodiments, the container is attachable to only the mobile phone. As will be appreciated, the mobile phone may be used as the user's digital wallet with the identification and/or payment being stored on the phone. In such embodiments, the container may hold the user's non-digital products, such as mints, allergy medication, lip balm, and/or other items that the user cannot download to their mobile phone (e.g., via the internet).

In some embodiments, as will be described, the container may include one or more compartments arranged to store and organize personal items. For example, the container may include a body with one or more dividers that at least in part define compartments or sections of the container. In some embodiments, the compartments may be the same shape and size or they may vary in size. For example, the compartments may be sized to accommodate differently sized personal items. In some embodiments, the user may customize the size of the compartments in the container. For example, in some embodiments, the container may include removable dividers that the user may insert into the container body at different locations to adjust the size of the compartments such that the compartments match the size of one or more personal items.

In some embodiments, the compartments may include one or more members to assist in keeping the personal item(s) in the compartment. For example, in some embodiments, the compartment may include one or more protrusions to help maintain a gel, wax, or paste (e.g., sunscreen, lip balm, or cologne or perfume gel) in the compartment. In such embodiments, the gel, wax, and/or paste may adhere to the protrusion(s) such that the gel, wax, and/or paste does not slide around in (or minimally slides around in) the compartment. The compartment also may include one or more seals to minimize or eliminate leakage of the personal item(s) from the compartment. For example, the compartment may include one or more seals that correspond with seals on the cover (as will be described) to help maintain the personal item(s) in the compartment.

In some embodiments, the compartments may be arranged to facilitate removal of the personal items from the compartment. For example, in some embodiments, the bottom or floor of the compartment may be angled or ramped toward an opening of the compartment. The corners of the compartment also may be curved to facilitate removal of the personal item from the compartment, such as for use or to clean the compartment.

In some embodiments, one or more compartment may include members to assist with dispensing and/or use of the personal item. For example, one of the compartments may include a curved cutting surface, such as a half-moon shaped surface, that may be used to dispense (e.g., cut) a portion of chapstick to the user.

As will be appreciated, personal items need not be stored in every compartment of the container. For example, in a container having eight compartments, personal items may be stored in only four or five of the compartments.

In some embodiments, the container may include a plurality of covers to contain and secure the personal item(s) in the compartments. In some embodiments, the covers may cooperate with the container to contain the personal item(s) in the compartments. For example, a plurality of covers may be attachable to the container such that each compartment is covered by a cover. In some embodiments, the covers may be removably attachable to the container. For example, the covers may be snap fit onto the container. The covers also may be fixedly attached to the container. In some embodiments, the covers also may be attached to the container by being integrally formed with the container body.

In some embodiments, the covers may be opened and closed to allow the user to access the personal items. For example, the covers may be moveable between a closed position and an open position such that the user may access the personal items. In some embodiments, the covers may be pivoted between the open and closed positions, although the covers may be opened and closed in other suitable manners. For example, the covers may be slidable between the open and closed positions in some embodiments. As will be appreciated, each compartment need not include a cover. For example, in some embodiments, only a subset of the compartments may include covers. In some embodiments, the covers may be removably attachable to the container, such that the user may attach covers only to the compartments being used for storage.

In still other embodiments, as will be described, the compartments may be defined by one or more drawers that are slidably received in the container. In such embodiments, the drawers can be pulled out of and/or pushed into the container to access the personal items.

In some embodiments, the covers may include visual and/or tactile indicia. For example, the covers may include numbers or other numerical identifiers, pictures, or other visual or tactile indicia. In some embodiments, the visual and/or tactile indicia may allow the user to organize the personal items in the different compartments. For example, in some embodiments, the indicia may allow the user to identify the personal item stored in a particular compartment. In an illustrative example, the indicia may include a sun to indicate sunscreen, a pizza slice to indicate antacids, a lip to indicate lip balm, the letter "A" to indicate Aspirin, a flower to indicate allergy medication, and wind to indicate breath mints (see, e.g., FIG. 11). The indicia also may include the numbers (e.g., 1 and 2), to indicate extra compartments that the user may use to store additional personal items.

In some embodiments, the containers may be designed for different activities, with the indicia corresponding to personal items that the user may bring for such activities. For example, the container may be designed for skiing, boating, fishing, and/or going to the beach. In an illustrative example where the container is designed for fishing and/or boating, the indicia may correspond to bug spray, waterproof matches, fishing line, a fishing hook, sunblock, and/or a pain reliever (e.g., Advil).

As will be appreciated, in some embodiments, the user may carry a single container with personal items. The user also may carry more than one container at the same time. For example, the user may insert two containers into slots in a wallet. In some embodiments, the user may have more than one container to store personal items and may pick and choose which of the containers to carry at a time. As will be appreciated in view of the above, the containers may be configured for different uses or activities. For example, a user may use a first container to store personal items for work, may use a second container to store personal items for home (e.g., medications, supplements, and sun block), and a third container for boating items.

Figure 3:
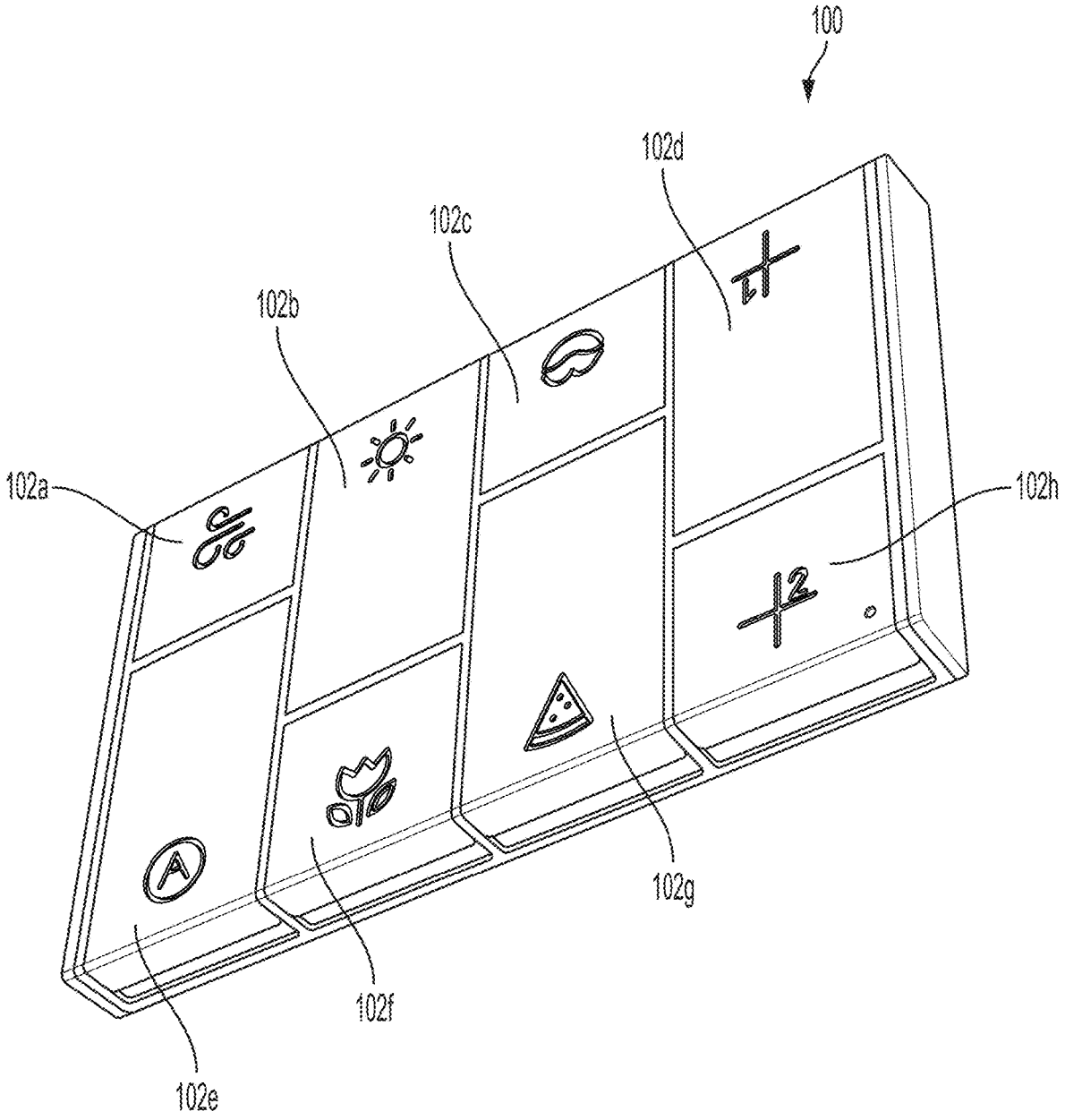
FIG. 3 is a perspective view of a container according to another embodiment.
Figure 4:
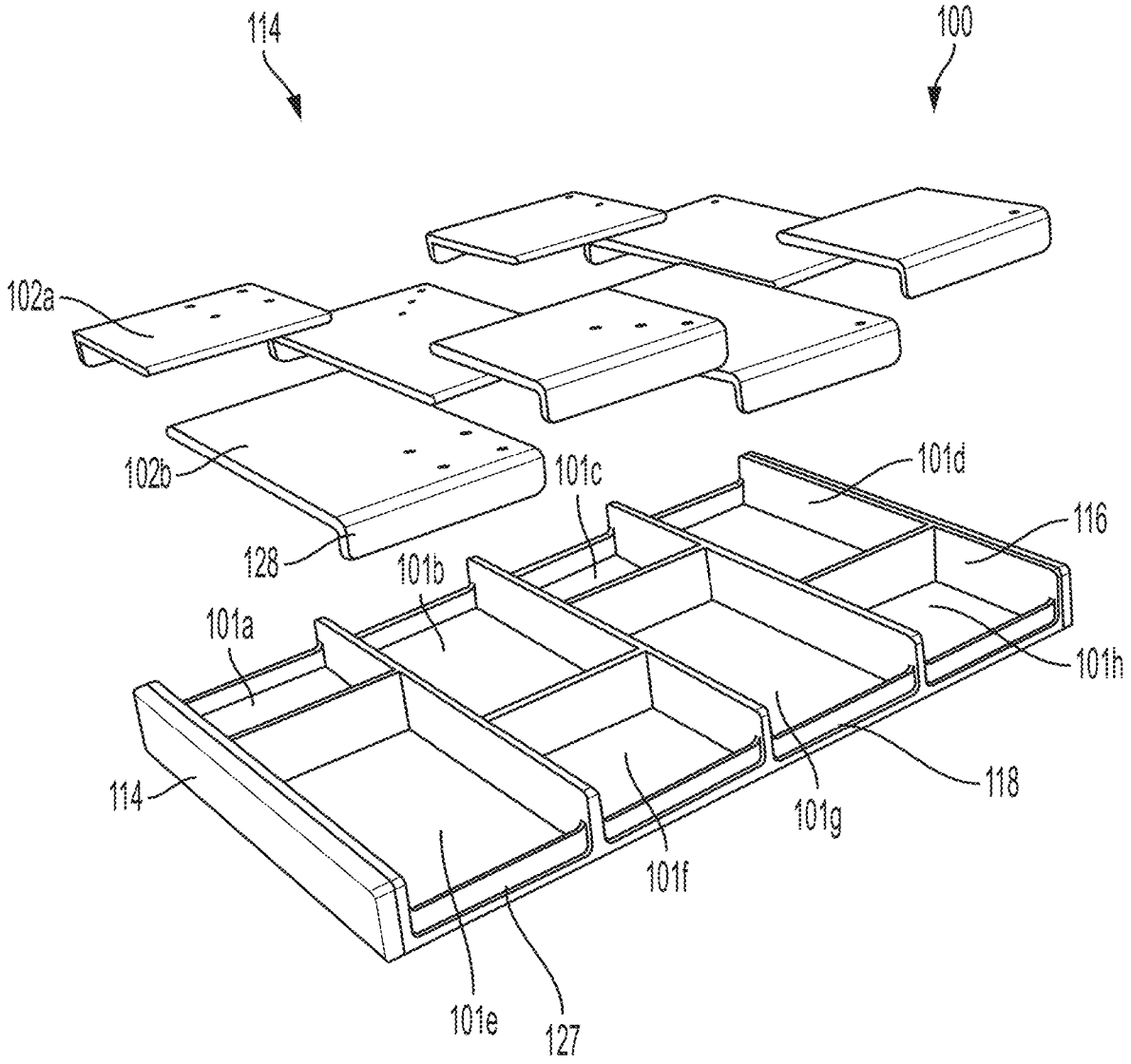
FIG. 4 is an exploded view of the container of FIG. 1.
Figure 5:
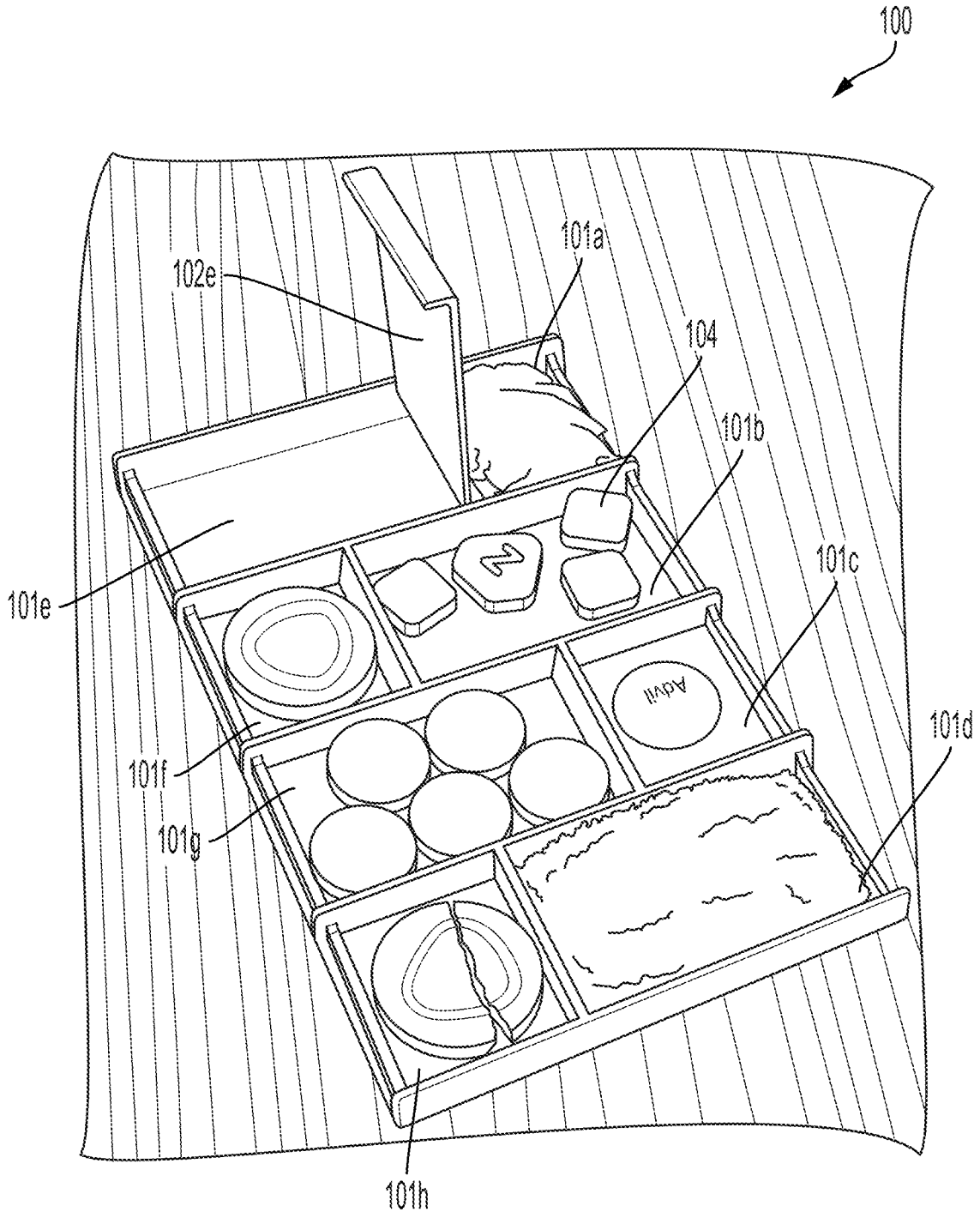
FIG. 5 is a perspective view of a container holding personal items, with a cover attached to one compartment.

Turning now to the figures, FIGS. 1-4 show a container 100 according to embodiments of the present disclosure. As shown in FIGS. 4 and 5, the container may include eight compartments 101*a*-101*h* arranged to store and/or organize personal items. FIGS. 1 and 3 show the container with corresponding covers 102*a*-102*h* attached to the container and covering the compartments. FIG. 5 shows an example of the container with personal items 104 in the compartments. As shown in FIG. 5, different types of personal items may be stored in the various compartments.

Although the container is shown as having eight compartments in these embodiments, the container may have more or fewer compartments. For example, the container may have one, two, three, four, or more compartments in other embodiments.

Figure 8:
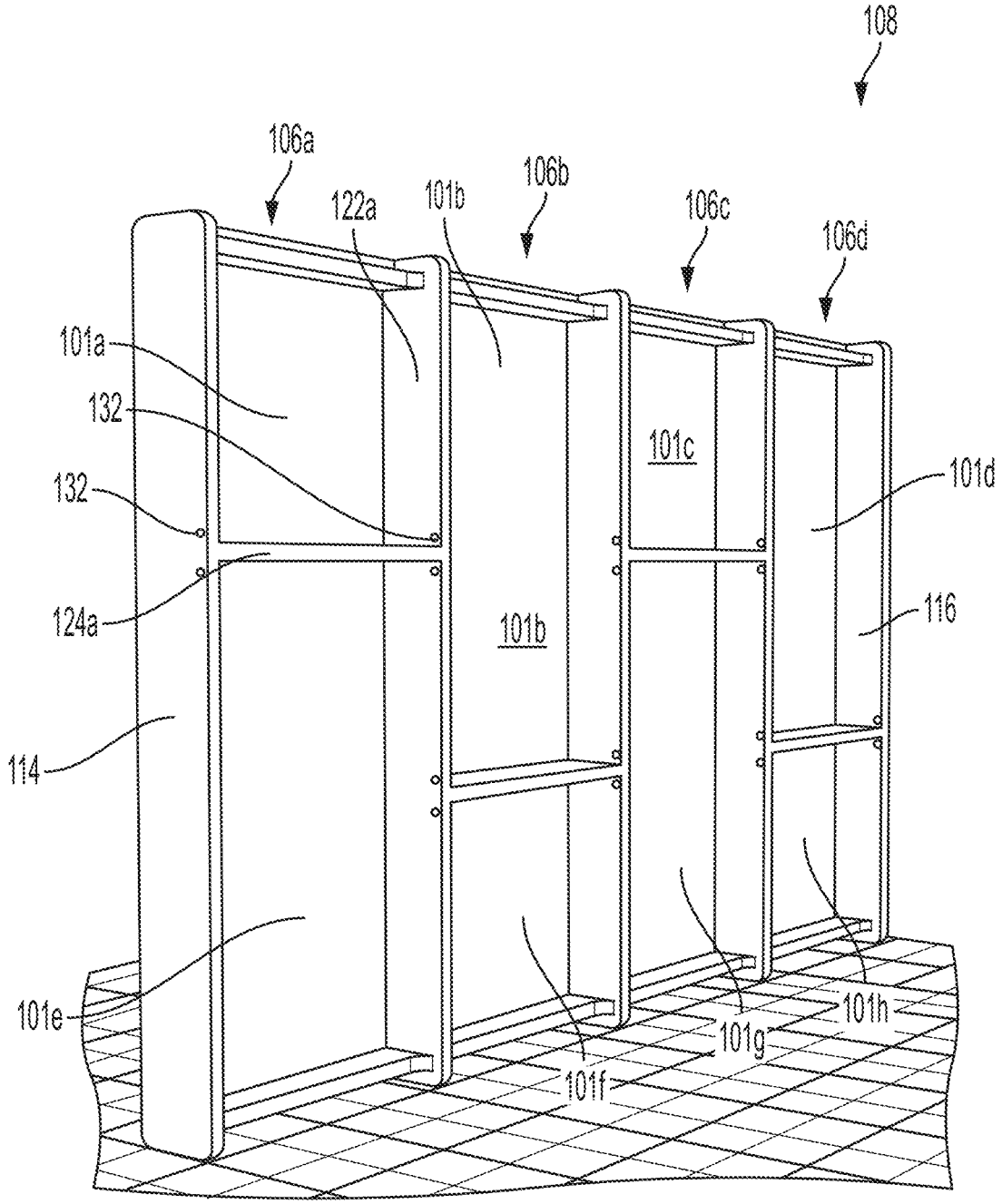
FIG. 8 is a perspective view of a body of a container according to some embodiments.
Figure 21:
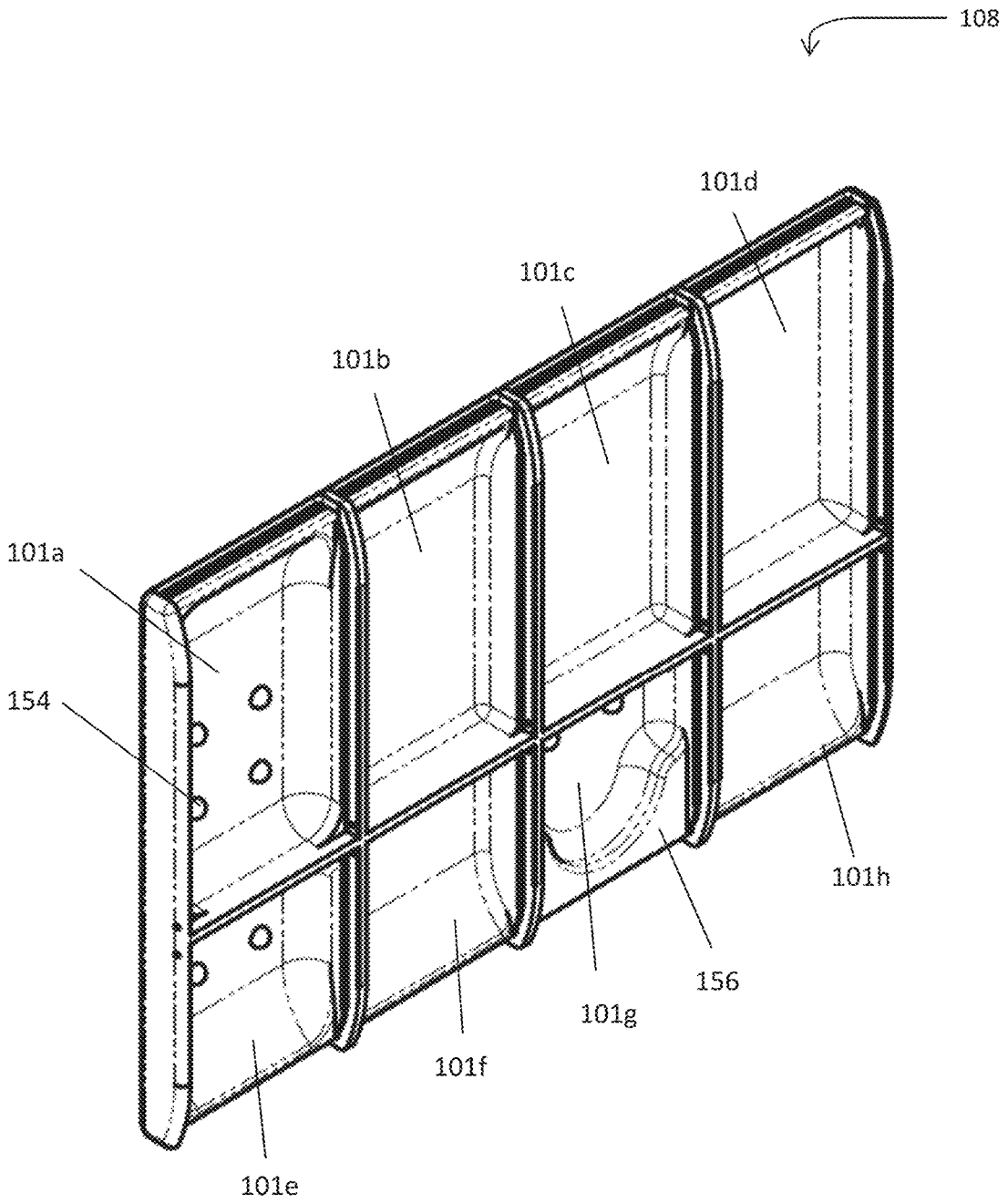
FIG. 21 is a perspective view of a container body according to another embodiment.
Figure 22:
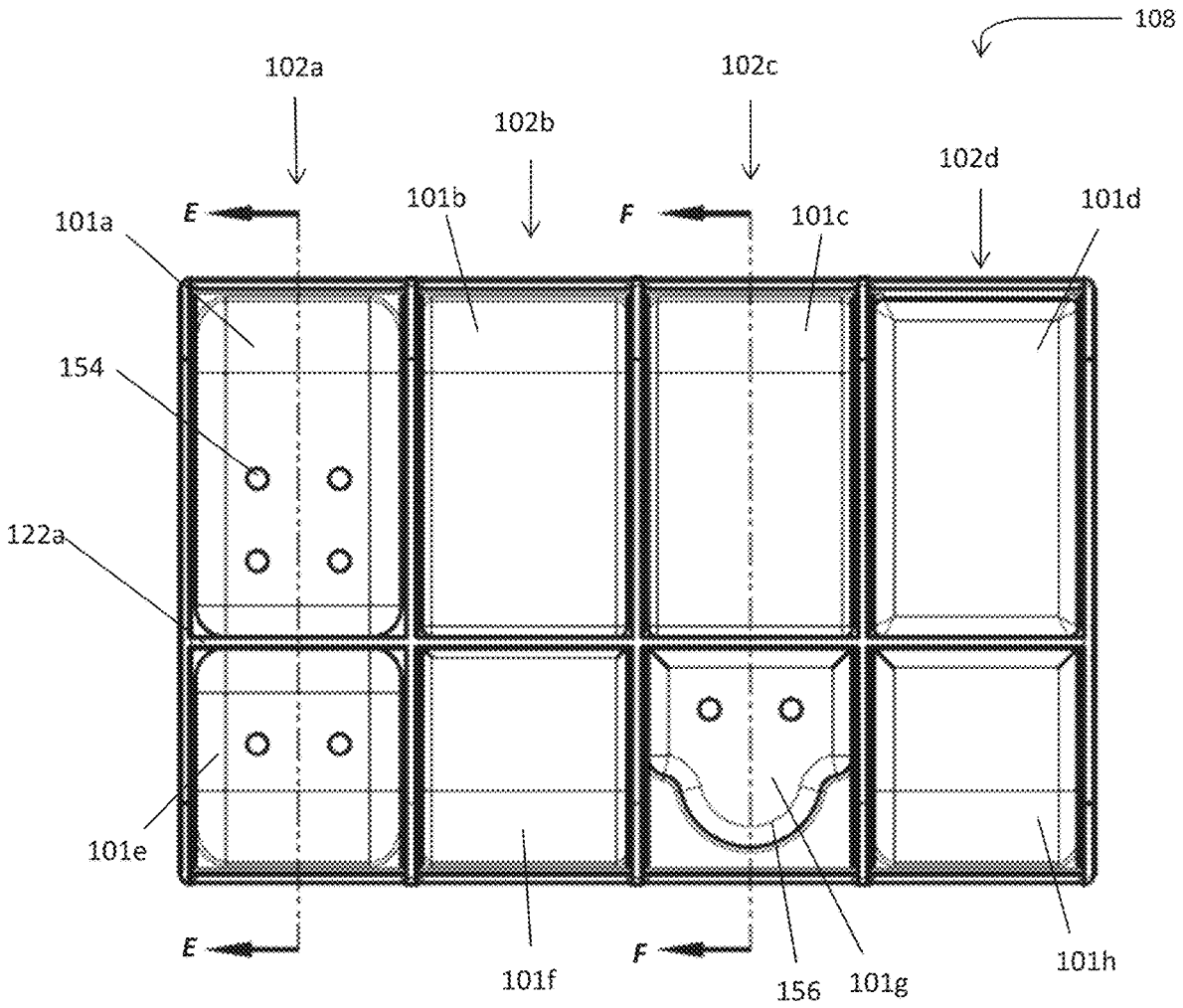
FIG. 22 is a front view of the container body of FIG. 21.

In some embodiments, the compartments may be the same size, although the compartments in the container may be different sizes, such as to accommodate differently sized personal items. In some embodiments, a subset of the compartments may be the same size. For example, as shown in FIGS. 4 and 8, four of the compartments 101*a*, 101*c*, 101*f*, 101*h* are a first size, while the remaining four compartments 101*b*, 101*d*, 101*e*, 101*g* are a second size. FIGS. 21 and 22 also shown an embodiment with four of the compartments 101*a*-*d* being a first size while the remaining four compartments 101*e*-*h* are a second, different size. In some embodiments, the differently sized compartments may be located next to one another in the container. For example, as shown in FIG. 8, in some embodiments, a first, smaller compartment (e.g., compartment 101*a*), may be positioned next to a second, larger compartment (e.g., compartment 101*b*). In such embodiments, the same size compartments may be staggered relative to one another. In other embodiments, such as those shown in FIGS. 21-22, the same sized compartments may be located next to one another (e.g., in the same row). In still other embodiments, all of the compartments be the same size.

Figure 14:
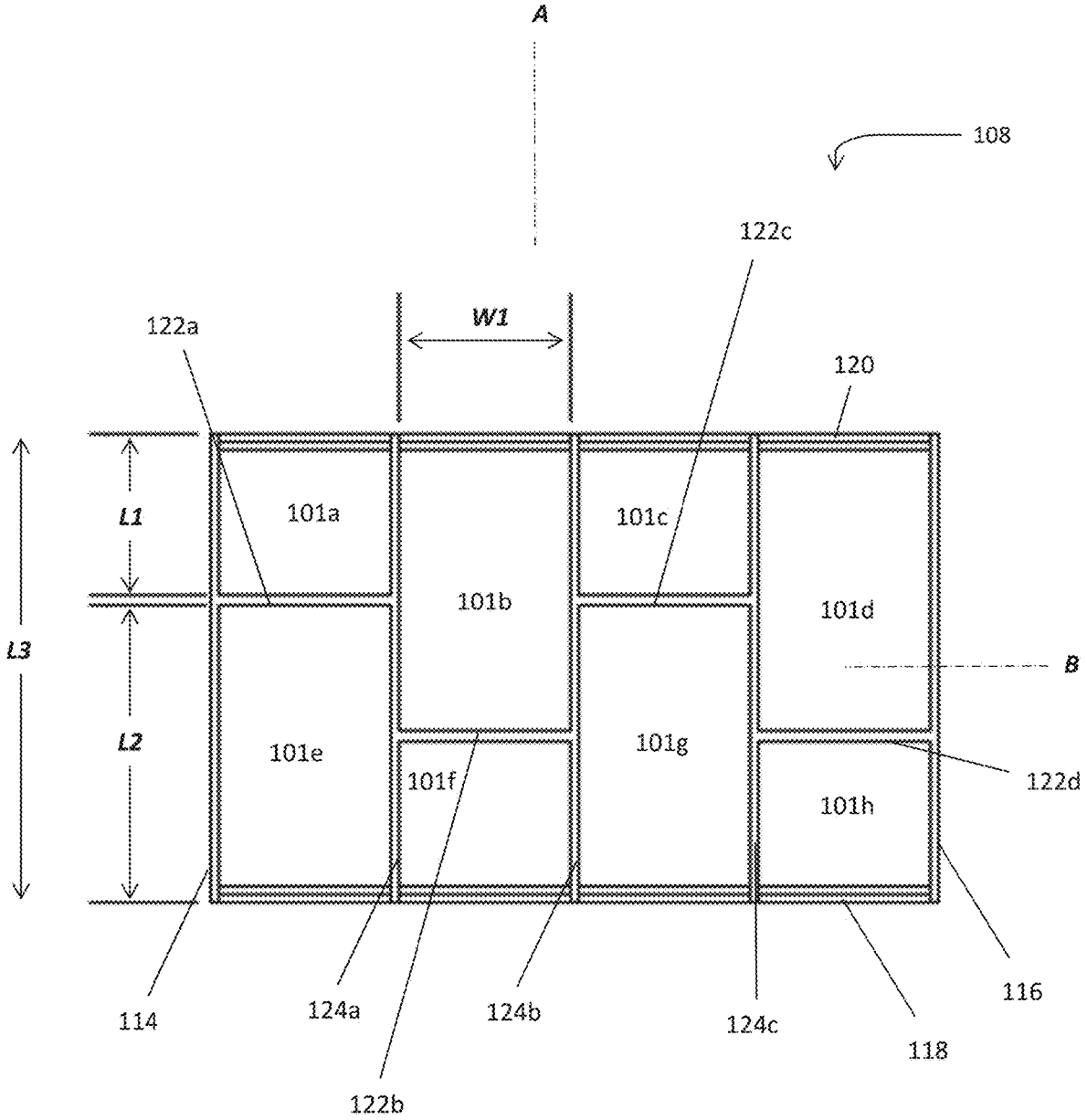
FIG. 14 is a top view of a container body of the container of FIG. 11.

In some embodiments, as shown in FIG. 14, the smaller compartment (e.g., compartment 101*a*) may include a length L1 of between about 0.5 and 1.0 inches. For example, a length L1 of the smaller compartment may be about 0.75 inches. In some embodiments, the larger compartment (e.g., compartment 101*e*) may include a length L2 of between about 1.0 inches and about 1.5 inches. For example, in some embodiments, the larger compartment may include a length of about 1.4 or about 1.5 inches. In some embodiments, the length L2 of the second compartment is about twice that of the length of the first compartment. As will be appreciated, the compartments may have other suitable lengths in other embodiments.

Figure 10:
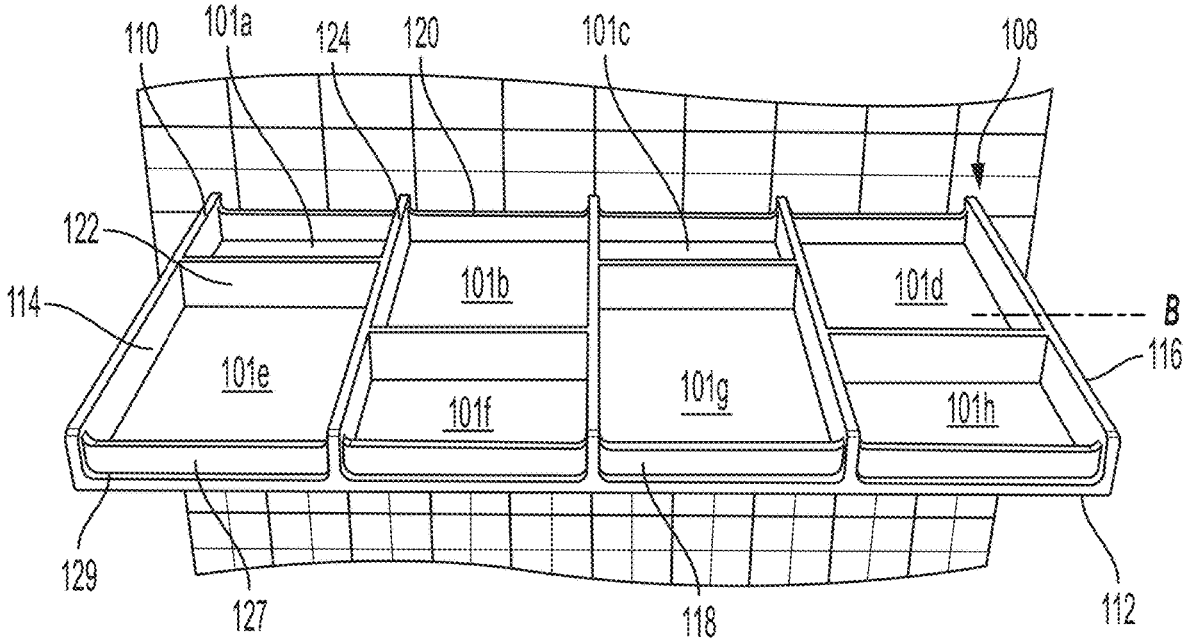
FIG. 10 is another perspective view of the container body of FIG. 8.

In some embodiments, as shown in FIGS. 8, 10, and 14, the compartments may be rectangular in shape (top view). The compartments also may be square in shape (top view) in some embodiments. In some embodiments, a subset of compartments may have the same shape. The shape of the compartments also may vary from compartment to compartment. As will be appreciated, the compartments may have other shapes than those shown in the figures. For example, the compartments may be circular, oval, triangular, other polygonal or other suitable shape.

In some embodiments, as shown in FIGS. 4 and 8, the compartments may be arranged in columns. As will be appreciated, in some embodiments, the columns may be the same shape and size, although the columns may be different sizes and shapes in other embodiments. As will be appreciated, although the compartments are shown as being arranged in columns, in other embodiments, the compartments also may be arranged in rows (see FIG. 22).

Figure 20:
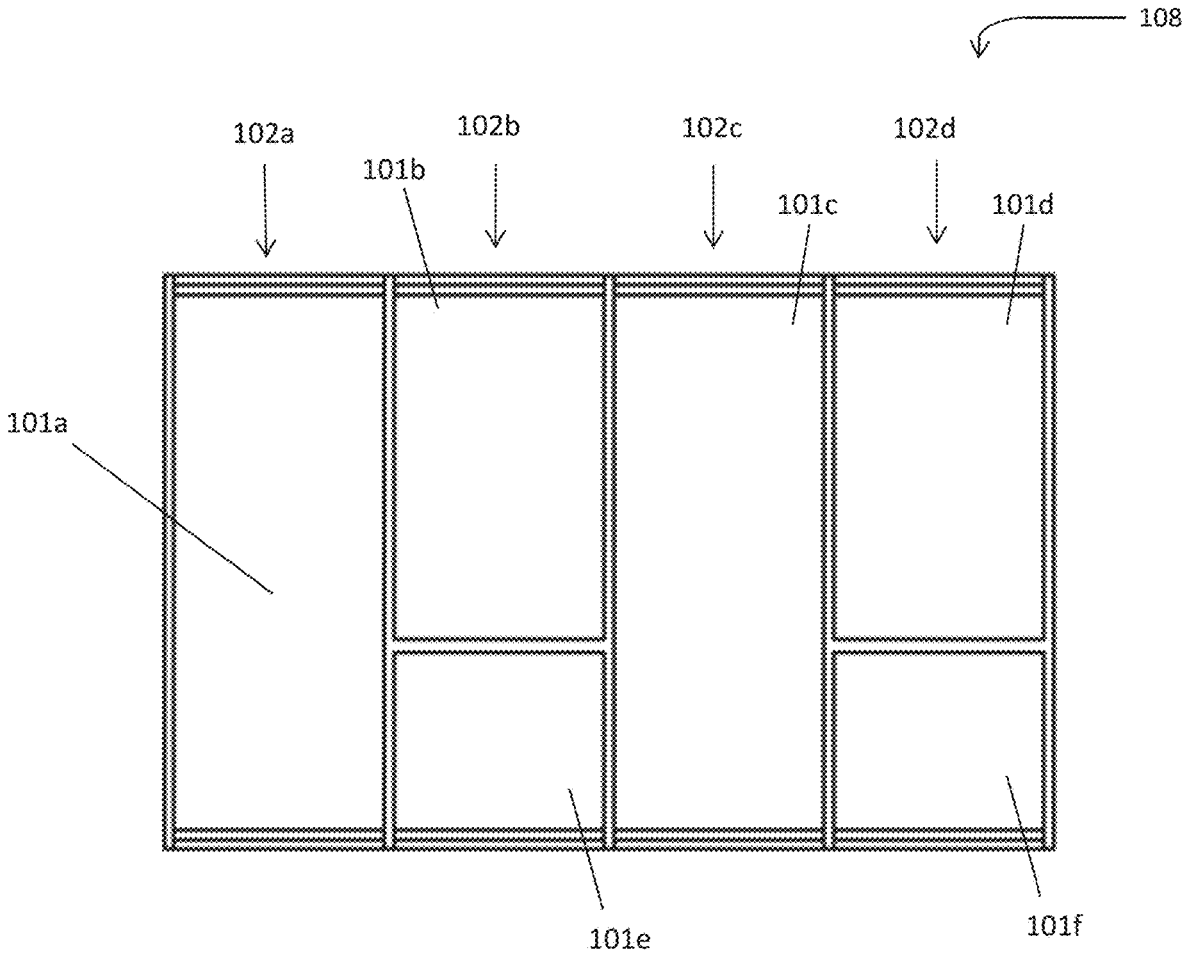
FIG. 20 is a top view of a container body according to another embodiment.

In some embodiments, as shown in FIG. 8, the container may include four columns 106*a*-106*d*. In some embodiments, each column may include the same number of compartments, such as two compartments (e.g., compartments 101*a*, 101*e* in the first column 106*a*) like that in FIG. 8. As will be appreciated, each column need not include the same number of compartments. For example, in some embodiments, as shown in FIG. 20, a first column 106*a* may include only one compartment 101*a*, while a second column 106*b* may include two compartments 101*b*, 101*e*. As will be appreciated, although the container is shown as having four columns in these embodiments, in other embodiments, the container may have more or fewer columns.

In some embodiments, a length L3 of the columns (see FIG. 14) may between about 1.5 and 2.5 inches. For example, in some embodiment, the length of the columns may be about 2.2 inches. As will be appreciated, in some embodiments, the length L3 of the column may equal the length of the first and second compartments, a thickness of a divider, as will be described, and a thickness of front and rear sides of the container body. In some embodiments, the length of the first column is the same as the length of the container. In some embodiments, the length of one of the columns may differ from a length of a second column.

In some embodiments, as shown in FIG. 14, the columns (including the compartments in each column) may have a width W1 of between about 0.5 and about 1.0 inches. For example, in some embodiments, the columns may be about 0.8 inches wide. As will be appreciated, each of the columns may have the same width, although the width of the columns may differ from column to column.

In some embodiments, as shown in FIGS. 4 and 8, each column of the container may include the same compartments. For example, as shown in these views, each column may include the first, larger compartment and the second, smaller compartment. In other embodiments, the compartment(s) in each column may vary from column to column. For example, as shown in FIG. 20, the first column may include a single, larger compartment, while the second column may include two smaller compartments. As will be appreciated, although the compartments in second column are shown as being differently sized in this view, it will be appreciated that the compartments may be the same size in the second column, or in another column. The container also may have more than two compartments in each column in other embodiments.

As shown in FIGS. 10 and 14, the container may include a body 108 having a top 110, a bottom 112, first and second (e.g., left and right) sides 114, 116, a front side 118, and a rear side 120. The body also may include one or more dividers 122, 124 arranged to divide the container into compartments 101*a*-101*h*. In some embodiments, the dividers may form one or more of the side or rear walls of the compartment.

As shown in FIGS. 10 and 14, in some embodiments, the container may include one or more longitudinally extending dividers 124*a*, 124*b*, 124 (also referred to herein as a longitudinal divider). For example, in some embodiments, the longitudinally extending dividers may extend between the front and rear sides 118, 120 of the container. As will be appreciated, although the longitudinal dividers are shown as extending all the way between the front and rear sides of the container in these embodiments, in other embodiments, one or more of the longitudinal dividers may extend only part way between the front and rear of the container.

In some embodiments, the longitudinally extending dividers extend substantially parallel to a longitudinal axis A of the container. As shown in FIG. 14, for example, the longitudinal dividers also may extend parallel to one another. The longitudinal dividers also may be noncoplanar. As will be appreciated, in some embodiments, the longitudinally extending dividers also may be angled relative to the longitudinal axis of the container. For example, one or more of the longitudinal dividers may be angled between about 5° and 45° relative to the longitudinal axis.

In some embodiments, the container also includes one or more laterally extending dividers 122*a*-122*d* (also referred to herein as a lateral divider). In some embodiments, one or more laterally extending divider may extend between first and second longitudinally extending dividers. For example, the second lateral divider 122*b* extends between first and second longitudinally extending dividers 124*a*, 124*b*. In other embodiments, one or more laterally extending divider may extend between a side of the container and a longitudinally extending divider. For example, a first lateral divider 122*a* extends between a first (e.g., left) side of the container and the first longitudinal divider 124*a*. In some embodiments, the lateral dividers form the rear walls of the compartments.

In some embodiments, the laterally extending dividers extend substantially parallel to a lateral axis B of the container. In some embodiments, the lateral dividers may be parallel to the lateral axis B of the container but not coplanar with the lateral axis of the container. In some embodiments, the lateral dividers may be parallel to one another. In some embodiments, the lateral dividers may be parallel to and coplanar with one another (see, e.g., FIG. 22). The lateral dividers also may be parallel to but noncoplanar with one another (see, e.g., FIG. 14). In some embodiments, one or more of the lateral dividers may be angled relative to the lateral axis of the container. For example, one or more of the lateral dividers may be angled between 5° and 45° relative to the lateral axis.

In some embodiments, as shown in FIG. 10, the dividers 122, 124 may extend from the bottom 112 of the container body to a top 110 of the container body. In such embodiments, the dividers may extend from the bottom of the container body to the cover when the cover is attached to the container. In some embodiments, the dividers may extend only part way between the bottom 112 and top 110 of the container body. As will be appreciated, the height of the dividers may be the same in some embodiments. In other embodiments, the height of the dividers may be different. For example, in some embodiments, the lateral dividers may be first height while the longitudinal dividers may be a second height different from the first height. In some embodiments, the height of the dividers may vary from divider to divider.

Figure 15:
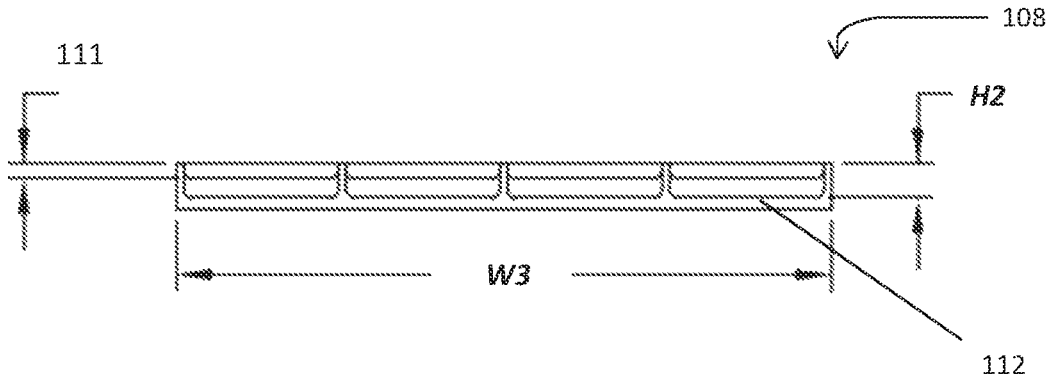
FIG. 15 is a front view of the container body of FIG. 14.
Figure 16:
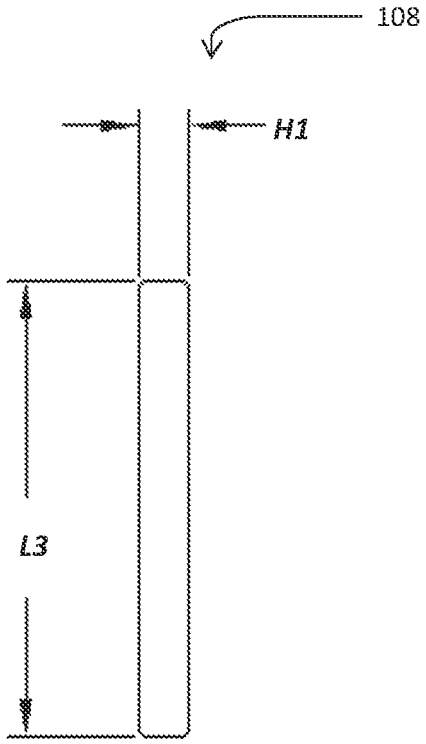
FIG. 16 is a side view of the container body of FIG. 14.

In some embodiments, a height of the dividers may be the same as a height of the container. As shown in FIG. 16, in some embodiments, a height H1 (e.g., thickness) of the body of the container is between about 0.125 and about 0.25 inches. For example, the height H1 of the body of the container may be about 0.24 inches in some embodiments. In some embodiments, a height of the dividers may differ from that of the height of the body container. For example, as shown in FIG. 15, the height of the body of the container may include a height H2 of the divider and a thickness of the bottom of the container body. In such embodiments, the height H2 of the dividers may be between about 0.125 and about 0.2 inches. For example, the height H2 of the dividers may be about 0.18 inches in some embodiments.

In some embodiments, as shown in FIGS. 10 and 15, a bottom 112 of the container may serve as the bottom or floor of each of the compartments 101*a*-101*h*. In such embodiments, a height of the compartment may be the same as the height of the divider H2. In some embodiments, the dividers may extend substantially perpendicular to the bottom of the container. As will be appreciated, one or more of the dividers also may be angled relative to the bottom of the container.

Figure 13:
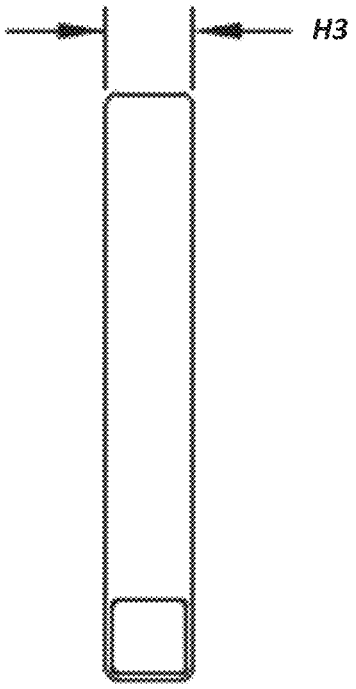
FIG. 13 is a side view of the container of FIG. 11.
Figure 12:
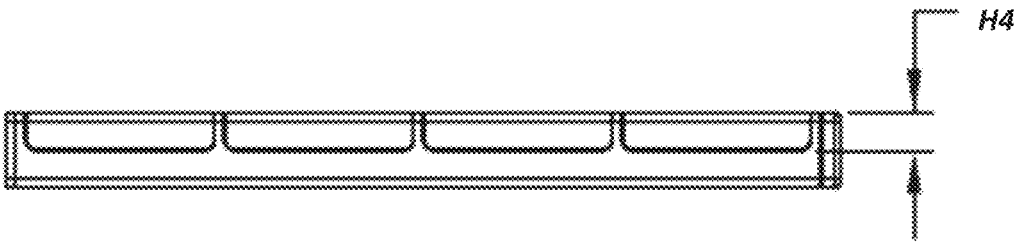
FIG. 12 is a front view of the container of FIG. 11.

In some embodiments, the height of the container H3 may be the same as that of the container body (see FIG. 1 3). In other embodiments, the height of the container H3 may be larger than that of the container body. For example, the height of the container H3 may include the height of the body and at least a portion of the cover, such as a thickness of the cover. As shown in FIG. 13, in some embodiments, a height H3 of the container may be between about 0.125 and about 0.35 inches. For example, in some embodiments, the height H3 of the container may be about 0.32 inches.

Figure 23:
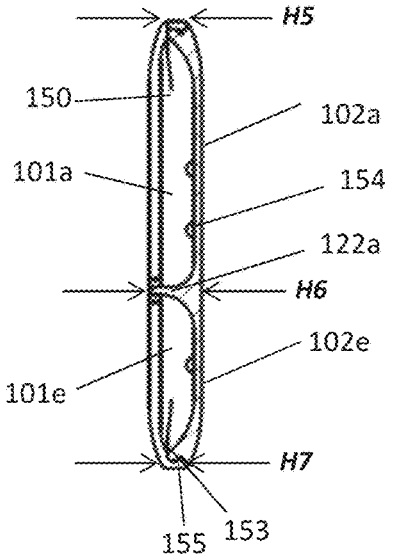
FIG. 23 is a side view of the container of FIG. 22 along line E-E, with covers shown attached.

In some embodiments, as shown in FIG. 13, the height (e.g., thickness) of the container may be substantially uniform between the front and rear sides of the container. For example, the height of the container may have the same height between the front and rear sides. In other embodiments, as shown in FIG. 23-34, the height of the container may differ between the front and rear sides of the container. For example, in some embodiment, as shown in FIG. 23, a height H5 of a rear side of the container may be smaller than a height H6 of a central region of the container body. A height H7 of a front side of the container also may be smaller than the height H6 of the central region of the container. In some embodiments, the height of the container is largest at the central region. In some embodiments, the central region may be a point equidistant between the front and rear sides of the container.

In some embodiments, the height of the container tapers between the central region and the front and/or rear sides of the container. For example, the height of the container may gradually taper between the central region and the front and rear sides. In other embodiments, the container may be the same height, except for regions at or near the front and rear sides of the container, where the height of the container tapers. In some embodiments, the height of the contain is symmetric about a lateral axis of the container. In some embodiments, the height of the container is symmetric about an axis perpendicular to the lateral and longitudinal axes. In such embodiments, a height at the front and rear sides may the same (and less than the height at the central region). In some embodiments, the height of the central region may less than about 8 mm. For example, the height of the central region may be between about 7 mm to 8 mm. In such embodiments, the height of the front and/or rear of the container may be less than about 5 mm in height, such as about 4 mm in height.

Figure 6:
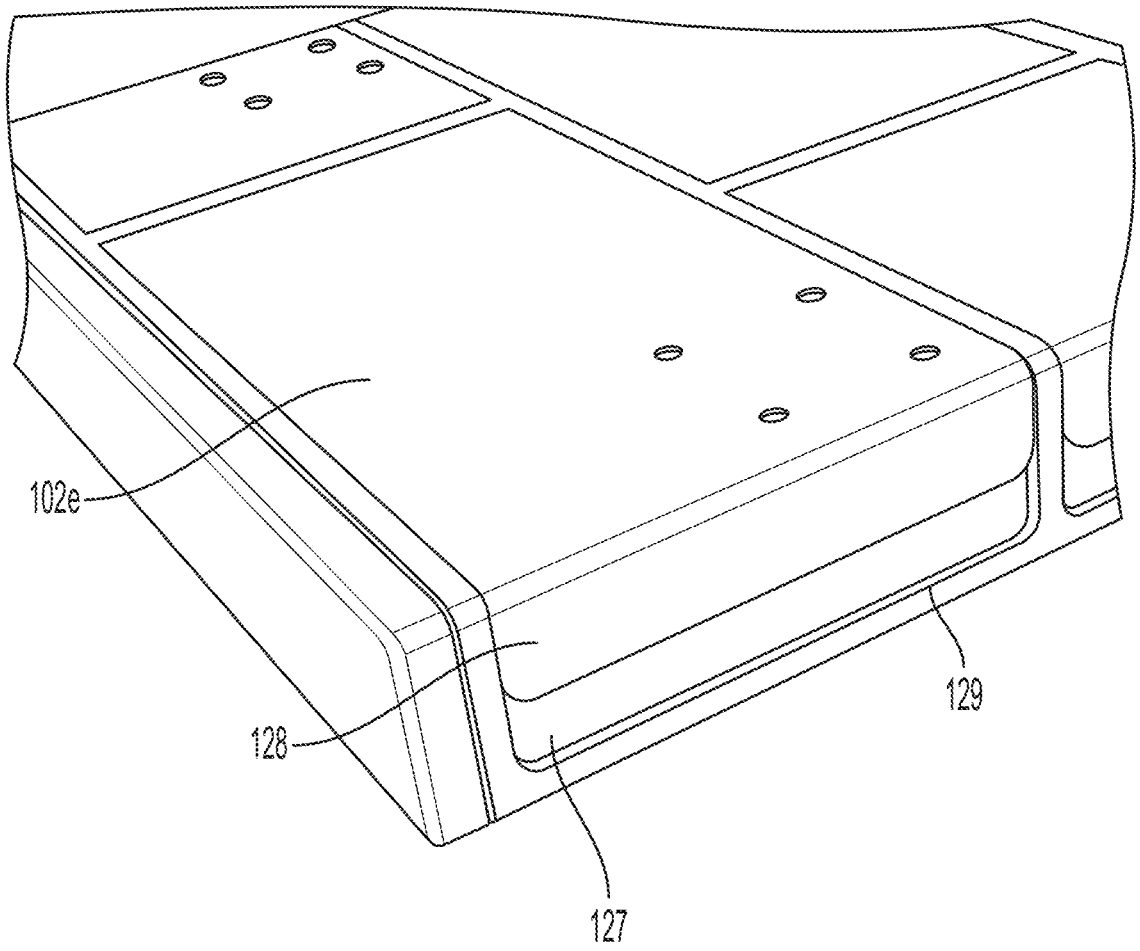
FIG. 6 is an enlarged view of a compartment of the container of FIG. 1, with a cover in a closed position.
Figure 9:
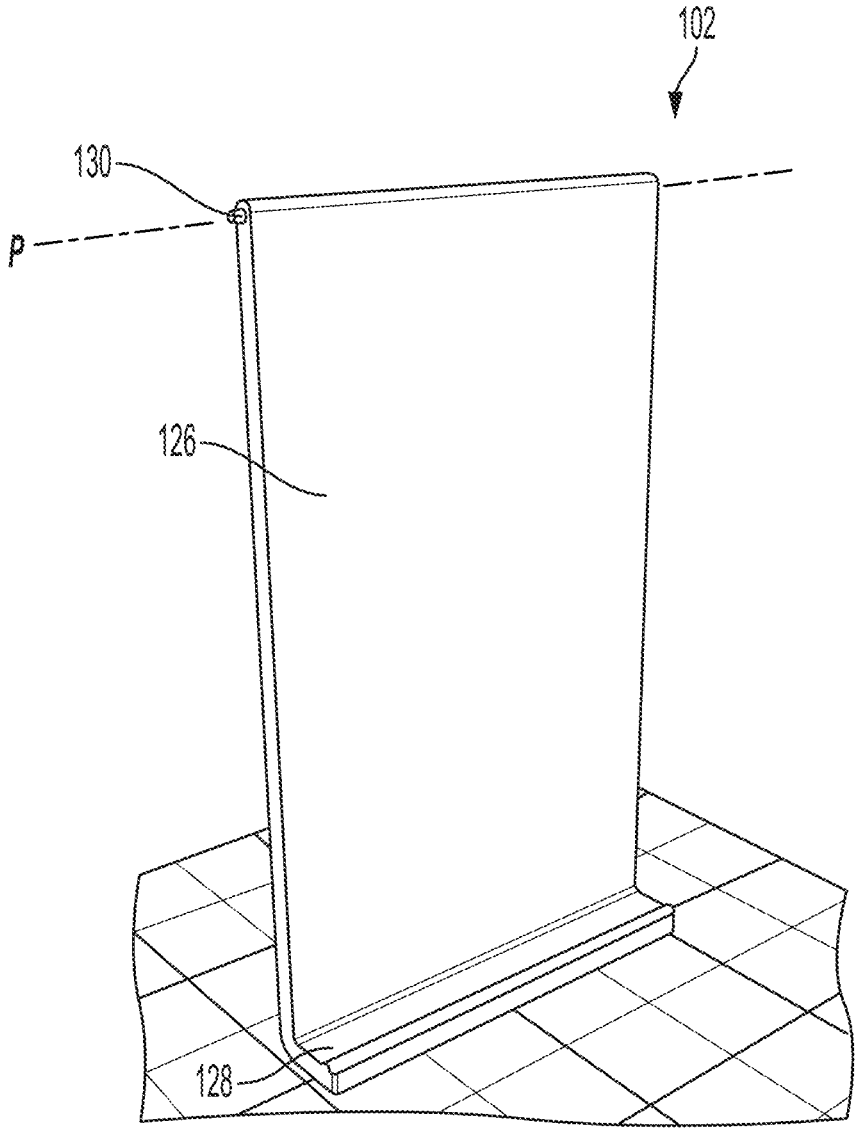
FIG. 9 is a perspective view of a cover of the container of FIG. 8 according to some embodiments.

As previously described, the container may have covers 102*a*-102*h* arranged to cover the compartments 101*a*-101*h* and secure the personal items in the compartments. In some embodiments, as shown in FIGS. 1 and 3, the covers may form a top of each compartment. For example, as shown in FIG. 9, the cover may include a top panel 126 arranged to cover the top of each compartment. In some embodiments, the covers also may form at least a portion of a front of the compartment. For example, as shown in FIGS. 6 and 9, the cover may include a front panel 128 that cooperates with the front and/or rear side of the container body to form the front wall of the compartment.

In some embodiments, the front panel 128 of the cover extends over at least a portion of a front side 118 and/or rear side 120 of the container body to form the front wall of the compartment. For example, as shown in FIGS. 3, 4, and 6, for the forward-facing compartments, (e.g., 101*e*-101*h*), the front panel 128 of the cover may extend over a front compartment portion 127 of the front side 118 of the container body. For the rearward-facing compartments (e.g., 101*a*-101*d*), the front panel 128 of the cover may extend over the front compartment portion 127 of the rear side 120 of the container body.

In some embodiments, as shown in FIG. 10, the front and rear sides of the container body may extend only part way between the bottom and top of the container body in the area of the front compartment portions 127. For example, in some embodiments, as illustrated in FIG. 15 the front compartment portions 127 may be spaced (see the arrow labeled 111) between about 0.05 and about 0.1 inches, such as about 0.08 inches from the top of the container body. In some embodiments, as shown in FIG. 15, the front compartment portion 127 of the front and/or rear side of the container body may be substantially U-shaped.

In some embodiments, the front compartment portions 127 of the front and/or rear sides 116, 118 of the container body may include a cutout 129 (see FIG. 10) arranged to receive at least a portion of the front panel 128 of the cover. In some embodiments, the cutout extents between adjacent lateral dividers and/or between a side of the container body and an adjacent lateral divider. In some embodiments, as shown in FIG. 15, the cutout also be substantially U-shaped. The cutout may have a shape and size that corresponds to the shape and size of the front panel of the cover. As shown in FIG. 6, when the cover is attached and in a closed position, the front panel extend over at least a portion of the cutout 129.

In some embodiments, engagement between the front panel and the front compartment portion locks the cover in the closed position. In some embodiments, the front panel and the front compartment portion may have corresponding engagement members that engage with one another to hold the cover in the closed position. The cover may other suitable arrangements for locking the cover on the container.

In some embodiments, as shown in FIG. 18, the front panel 128 of the cover may extend substantially perpendicular to the top panel. The top panel also may be angled relative to the front panel in other embodiments. In some embodiments, the top panel is connected to the front panel. In some embodiments, as shown in FIG. 18, the cover may be curved where the top panel and the front panel are connected to one another. In some embodiments, a radius of curvature of the curved connection is between about 0.0125 and 0.05. For example, in some embodiments, the radius of curvature R is about 0.04.

In some embodiments, the cover may include only a top panel and an engagement member. For example, as shown in FIG. 23, the engagement member 153 (see also FIG. 25) may be attachable to a curved top panel of the cover, such that the top panel engages directly with the container body (e.g., via a corresponding engagement member 155). In some embodiments, the corresponding engagement member 155 is formed on a front side of the compartment, such as on the front and/or rear side of the container body. In such embodiments, the cover may form only a top of the compartment. As will be appreciated, in some embodiments, a first cover may form only the top of compartment of the container while a second cover may form the top and at least a portion of the front of a compartment of the same container.

In some embodiments, the engagement member on the container body may include a channel for receiving the engagement member on the cover. As will be appreciated, the engagement member on the container body may have a shape and size that corresponds to the shape and size of the engagement member on the cover. In some embodiments, the engagement member on the container bod y may be arranged to flex outwardly upon insertion of the cover and to snap back into a locked position when the engagement member of the cover is received in the channel. The engagement members may have other suitable arrangements in other embodiments.

In some embodiments, as shown in FIG. 18, the cover may have a thickness T of between about 0.0125 and about 0.05 inches. For example, in some embodiments, the thickness T of the cover is about 0.04 inches. In some embodiments, the cover has a length L4 of between about 0.5 inches and about 1.5 inches. As shown in FIG. 17, for example, a cover corresponding to a longer compartment (e.g., compartment 101*e*) may have a length of between about 1.4 inches in some embodiments. As will be appreciated, the length of the cover may be less than that of the length of the compartment. For example, in some embodiments, the compartment has a length of 1.378 while the cover has a length of about 1.374. In some embodiments, the front panel of the cover may have a height H2 of between about 0.125 and about 0.2 inches. For example, the height H2 of the front panel of the cover may be about 0.15 inches in some embodiments. As shown in FIG. 14, the height of the cover H4 may be between about 0.125 and about 0.175 inches, such as about 0.16 inches in some embodiments.

In some embodiments, the cover is arranged to be attached to the container body (e.g., fixedly attached). In some embodiments, as shown in FIG. 9, the cover may include first and second pins 130 that engage with and are received in corresponding openings in the compartment. In some embodiments, the pins extend from first and second lateral sides of the cover. In some embodiments, as shown in FIG. 8, the openings may be formed in a side 114, 116 of the container body and in an adjacent longitudinal divider, or formed between adjacent longitudinal dividers. For example, as shown in FIG. 8, openings may be formed on the first (e.g., left) side 114 of the container body and the adjacent first longitudinal divider 122*a*.

As shown in these views, the openings may be formed in a rear portion of the compartment, near the corresponding lateral divider. For example, in FIG. 8, openings are formed adjacent the lateral divider 124*a* that extends between the first side 114 of the container body and the first longitudinal divider 124*a*.

As will be appreciated, the shape and size of the pins correspond to the shape and size of the corresponding openings. For example, in some embodiments, the pins and openings may be substantially circular in cross section (see FIGS. 8 and 9). The pins and openings also may have other suitable shapes, such as square, oval, triangular, other polygonal shape, or other shape.

Although the openings are shown as being formed in the container body for receiving corresponding pins on the cover, it will be appreciated that the openings may be formed on the cover for receiving corresponding pins on the container body.

In some embodiments, the cover is arranged to pivot between an open and closed position to allow the user to access his or her personal items. In some embodiments, the covers pivot about a pivot axis P (see FIG. 9), which may be substantially parallel to the first and second pins 130.

Figure 7:
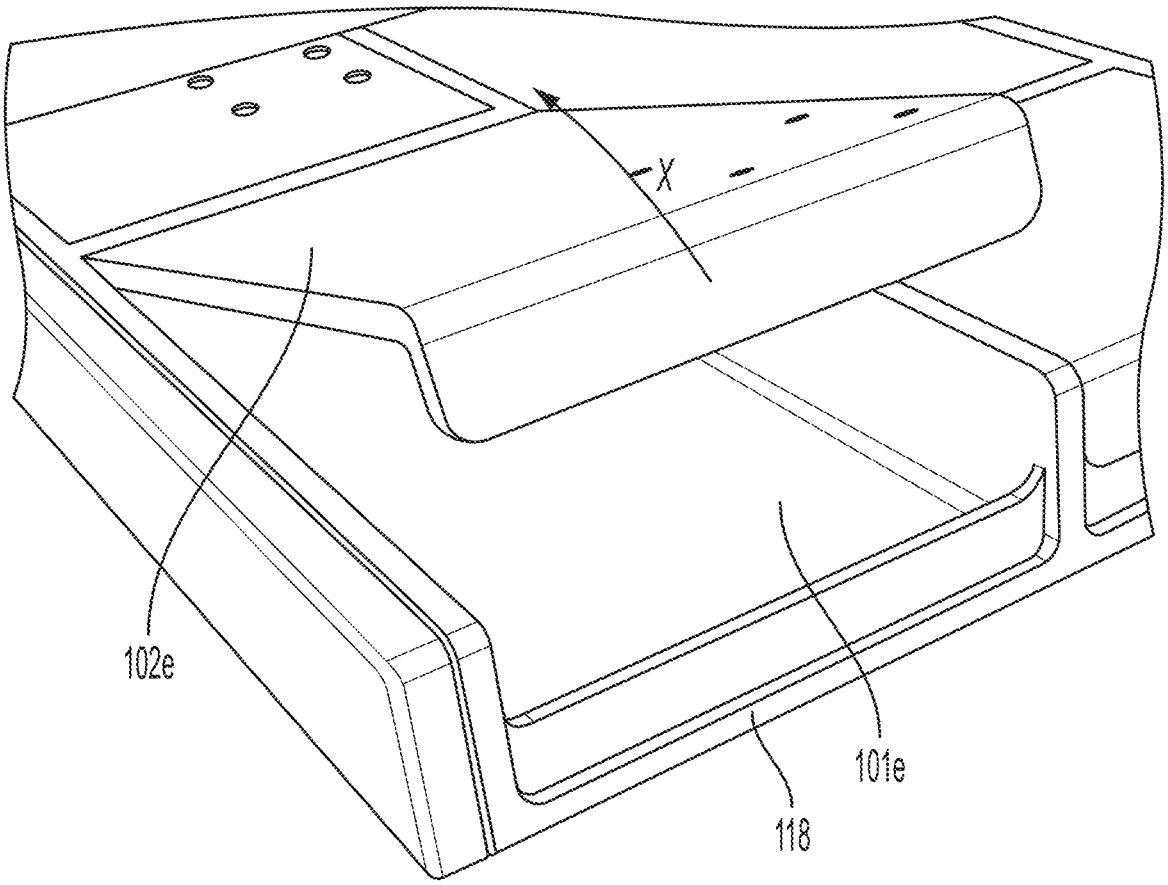
FIG. 7 shows the compartment of FIG. 6, with the cover in an open position.

FIG. 7 shows a cover in an open position, after being pivoted from the closed position of FIG. 6. As shown in FIG. 7, in some embodiments, one or more covers may be arranged to open in a direction away from the respective front and/or rear side 118, 120 of the container (see the arrow labeled X in FIG. 7). For example, one or more covers may open towards the lateral axis (see FIG. 14) of the container. In other embodiments, one or more covers may be arranged to open in a direction towards the respective front and/or rear side 118, 120 of the container (see the arrow labeled Y in FIG. 32). For example, the covers may pivot in a direction away from the lateral axis of the container. In such embodiments, the pivot axis of each the cover may be located at or near the respective front and/or rear side of the container (see the pivot axis P in FIG. 33). As will be appreciated, in FIG. 7, the pivot axis of each cover may be located at or near the lateral axis of the container).

As will be appreciated, in some embodiments, all of the covers in the container may pivot either towards or away from the lateral axis of the container. In other embodiments, some of the covers may pivot towards the lateral axis while other covers may pivot away from the lateral axis. In other words, some of covers may pivot inwardly while others pivot outwardly.

In embodiments in which the covers pivot towards the respective front and/or rear side of the container, the container may include a dimple 170 (see FIG. 31) in between adjacent covers of the same column. For example, the dimple may include a depression in one of the lateral dividers between compartments. In such embodiments, the user may insert his/her fingertip in the dimple and below the edge of the cover, and then open the cover to expose the contents of the compartment.

Figure 33:
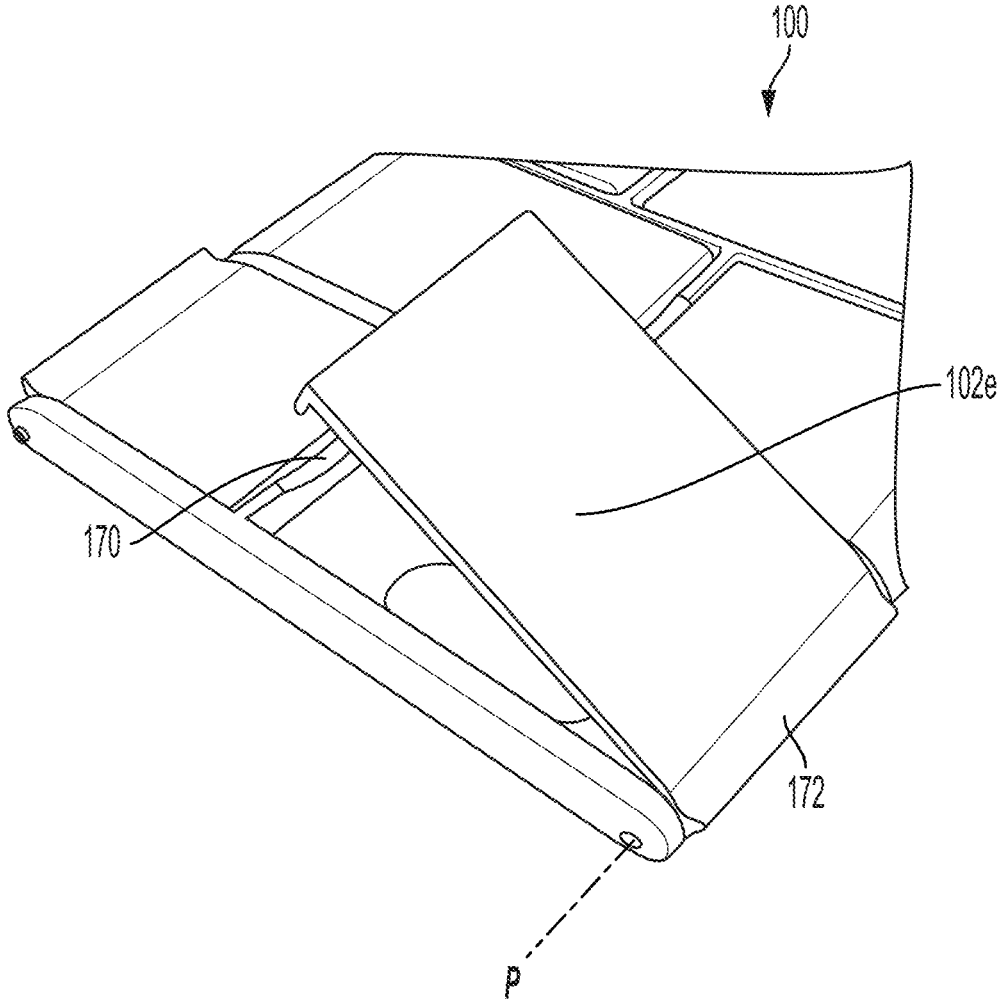
FIG. 33 is a perspective view of a portion of a container according to some embodiments, with a cover of the container shown in an open position.

In some embodiments, as shown in FIG. 33, the container may be arranged such that there is more than one way to open a cover. For example, as shown in FIG. 3, the container may include a dimple 170 between the covers such that user may inset his/her fingertip below the cover to thereafter open the cover. The cover also includes a ledge 172 that the user may press to move pivot the cover about the pivot axis and open the cover. In some embodiments, the ledge may protrude upwardly from a top of the cover. The ledge also may produce outwardly and beyond a front and/or rear side of the container.

Although the container is shown as having both a dimple and the ledge on the cover in FIG. 33, in other embodiments, the container may include only the ledge on the cover. The container also may have other arrangements for opening the cover in other embodiments.

Figure 29:
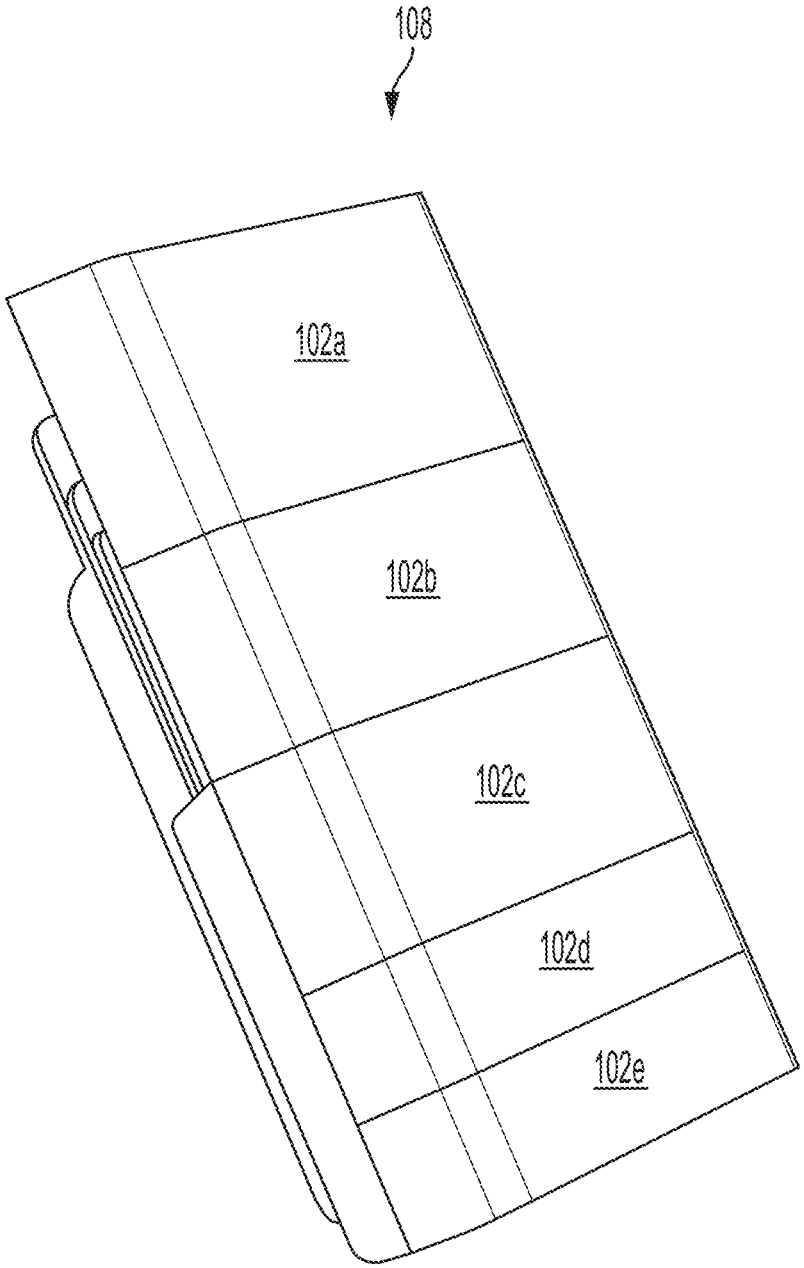
FIG. 29 is a perspective view of a container according to still another embodiment.
Figure 30:
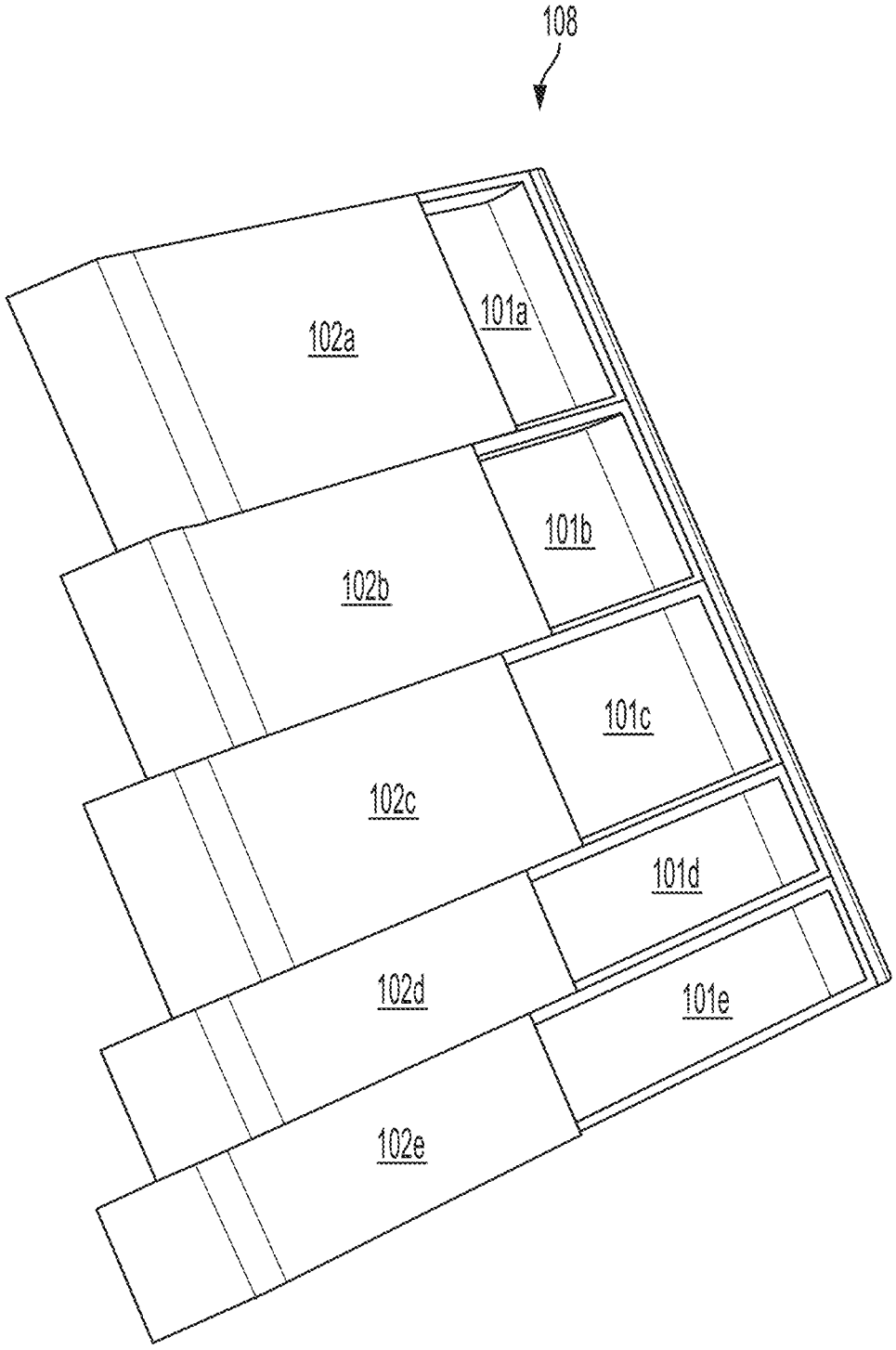
FIG. 30 is the container of FIG. 29, with covers shown in open positions.
Figure 31:
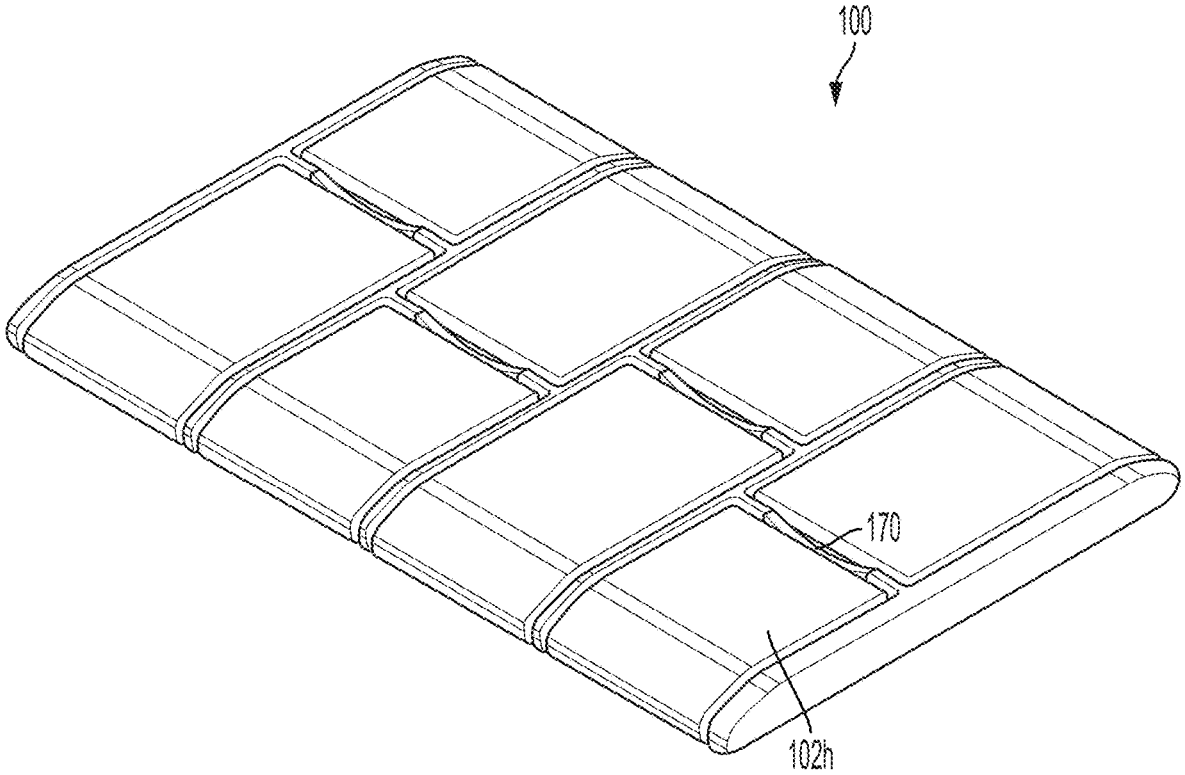
FIG. 31 is a perspective view of a container according to another embodiment.
Figure 32:
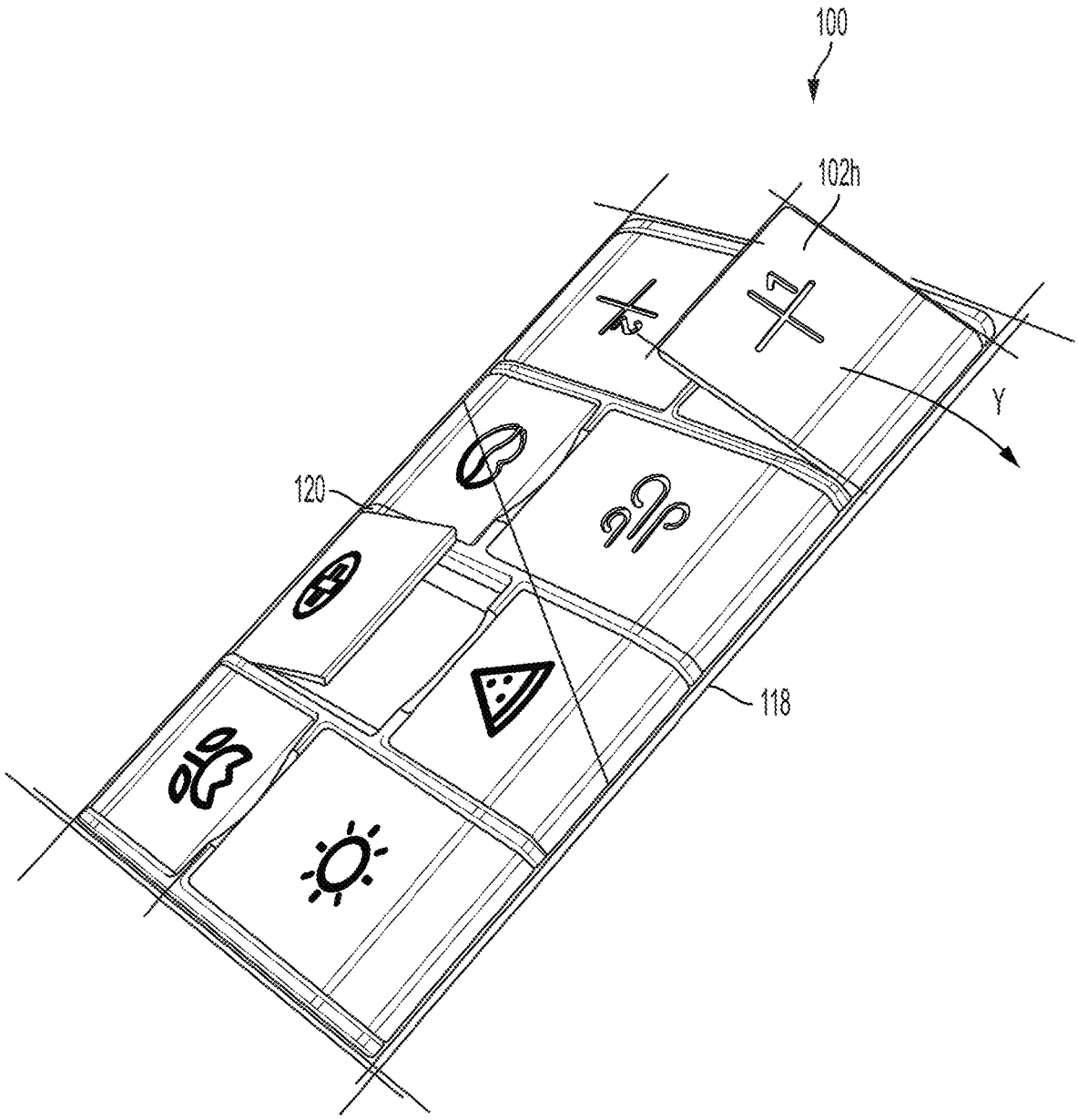
FIG. 32 is a perspective view of a container according still another embodiment.

As will be appreciated, the cover may be attached to the container in other suitable arrangements. For example, as shown in FIGS. 29 and 30 in some embodiments, the cover may be slidably attached to the container body. In such an example, the user may slide the cover between the open and closed positions. As shown in these views, in some embodiments, the container may include only one compartment per container, with the longitudinal dividers extending all the way between the front and rear of the container body. As with the above, the cover may form a top of the compartment and, in some embodiments, and at least a portion of the front of the compartment. In such embodiments, a front panel of the cover may be angled relative to the top of the cover.

In some embodiments, the cover may be integrally formed with the container body. For example, the covers may be integrally formed with the lateral dividers in some embodiments. In some embodiments, (see, e.g., FIG. 23) a lateral divider may be integrally formed with first and second covers, the first and second covers arranged to cover first and second compartments in the same column of the container. In such embodiments, the covers may be integrally formed with the container body.

In some embodiments, the cover may be arranged to seal the compartment to contain the personal item(s) in the compartment. In such embodiments, the cover may include a seal that engages with a corresponding seal on the compartment when the cover is locked in the closed position. As will be appreciated, the seal need not extends around an entire perimeter of the compartment. For example, the seal may extend along only a portion of the perimeter of the compartment.

Figure 11:
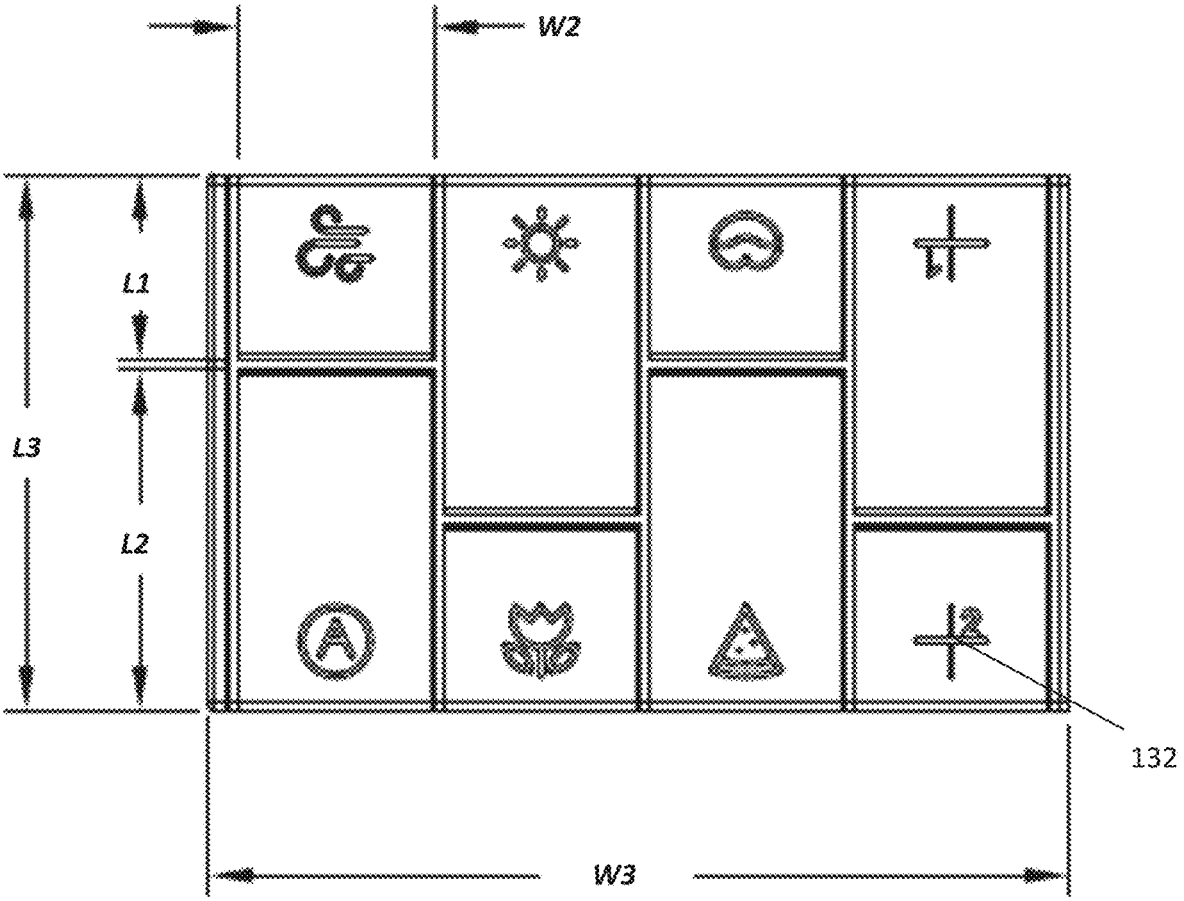
FIG. 11 is a top view of a container according to some embodiments.

In some embodiments, as shown in FIG. 11, the cover may include indicia 132 which may allow the user to organize and identify the items in each compartment. As shown in FIG. 1, in some embodiments, the indicia may include an image. As shown in FIG. 1, the indicia also may include numerical identifiers (e.g., different numbers of dots) or numbers. In some embodiments, the indicia may be tactile such that a person may feel the image or numerical indicator. In some embodiments, this may allow a visually impaired person to organize and later identify the personal item in a specific compartment.

Although the containers are shown as having compartments only on a top of the container, it will be appreciated that compartments may be formed on both the top and the bottom of the container in other embodiments. In such embodiments, a floor a first compartment may be formed in the bottom of the container, while floor of a second compartment may be formed in the top of the container.

In such embodiments, the user may rotate the container to access the desired compartment. For example, in some embodiments, the user may access a compartment on the top of the container when the top of the container is facing upwardly. For purposes herein, facing upwardly means that the container is facing in a direction away from a floor (e.g., on which the user is standing) and towards the user. Once the user has accessed the compartment on the top of the container, the user may rotate the container until the bottom of the container is upwardly facing. The user may then access the desired compartment in the bottom of the container.

In some embodiments, the container may have a width W3 (see FIG. 11) of between about 3.0 inches and about 5 inches. For example, in some embodiments, the width of the container may be about 3.5 inches.

Figure 24:
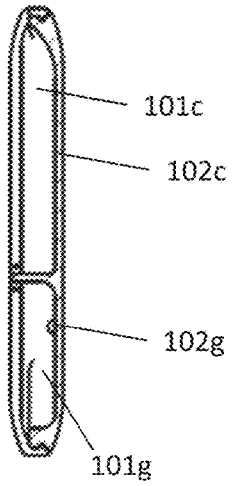
FIG. 24 is a side view of the container of FIG. 22 along line F-F, with covers shown attached.
Figure 25:
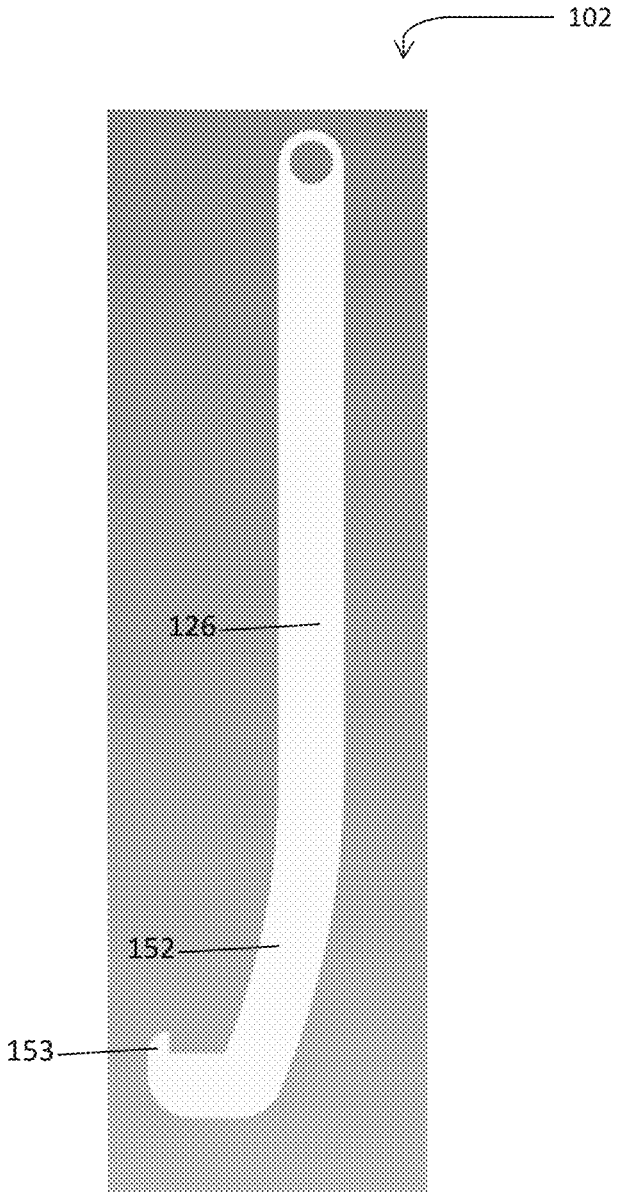
FIG. 25 is a side view of a cover of the container of FIG. 21.

In some embodiments, as shown in FIG. 24, one or more compartments may be substantially rectangular in cross-sectional shape, with four sides (see compartment 101*g*). In other embodiment, as shown in FIGS. 23 and 24, the compartments also may have other cross-sectional shapes (see compartments 102*a*, 102*e*, and 102*c*). For example, as described above, in some embodiments, the container may increase in height towards a central region of the container. In such embodiments, the container body and compartments may have different shapes and sizes. For example, a height of the compartment may increase from a front of the compartment toward the back of the compartment. In some embodiments, the compartments may have a curved top and a substantially flat bottom surface (see, e.g., compartment 101*e*). In such embodiments, as shown in FIG. 25, the cover also may have a curved shape.

In some embodiments, as shown in FIG. 23, at least a portion of the bottom or floor 150 of the compartment may be angled. In some embodiments, the floor may be angled upwardly toward the opening of the compartment (e.g., when the cover is in an open position). In some embodiments, the angled floor of the compartment may facilitate removal of a personal item from the compartment. For example the angled surface may facilitate movement of the personal item toward the opening when the cover is in the open position. In some embodiments, because of the small height of the compartment, the personal item may otherwise move toward a back of the compartment when the cover is in a closed position. For example, as shown in FIG. 25, the front portion 152 of the top panel of the cover may be angled downwardly (e.g., towards the floor of the compartment) to make the front of the compartment the smallest portion of the compartment.

As shown in FIGS. 21 and 22, the compartment may include one or more members to keep the personal item(s) from moving in the compartment. For example, as shown in the first and fifth compartments 101*a*, 101*e*, the compartment may include one or more protrusions 154 that extend into the compartment. In some embodiments, the personal item(s) may stick to the one or more protrusions, which may minimize or even eliminate movement of the personal item(s) in the compartment. As shown in FIGS. 21 and 22, each compartment need not include a protrusion. Also, the number of protrusions may vary from compartment to compartment. In some embodiments, the protrusions may be semi-hemispherical in shape, although the protrusions may be square, triangular, other polygonal, or other suitable shape. The shape of the protrusions may be the same throughout the container, although the shape of the protrusions may vary from protrusion to protrusion or from compartment to compartment.

In some embodiments, as also shown in FIGS. 21 and 22, one or more compartments (see compartment 101*g*) may include one or more dispensing members 156. For example, one or more compartments may be arranged to help dispense a portion of the personal item(s) to the user. As shown in FIGS. 21 and 22, the dispensing member 156 may include a curved surface arranged to cut or portion the personal item(s). For example, the curved surface may cut a portion of chapstick for dispensing to the user. As will be appreciated, although the curved surface is shown as being a half-moon shape, it may have other suitable shapes in other embodiments.

Figure 34:
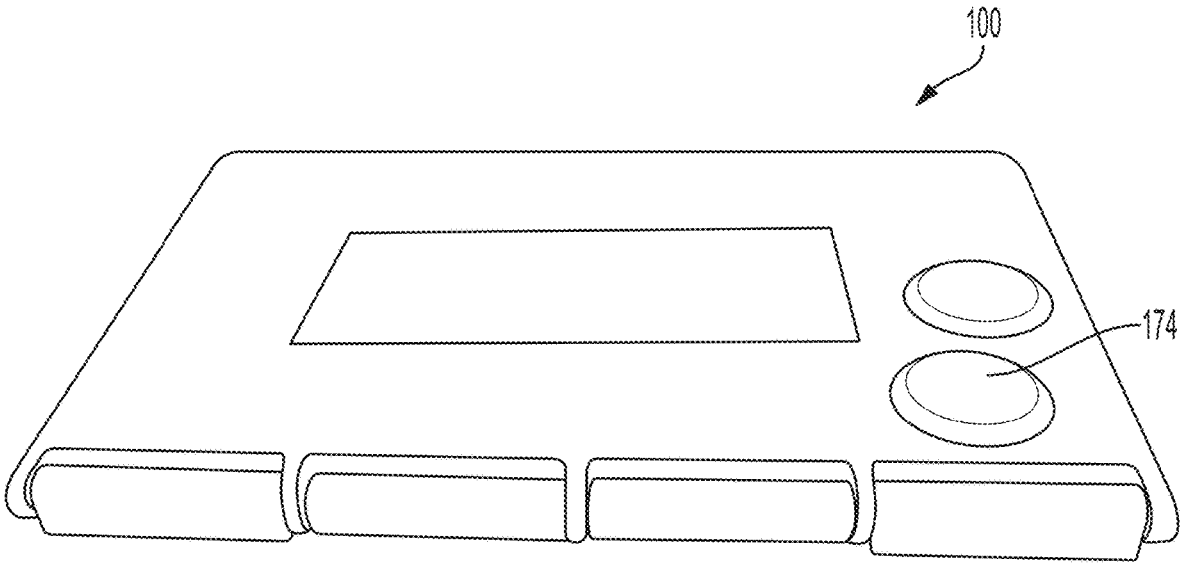
FIG. 34 is a bottom view of a container according to some embodiments.

In some embodiments, as shown in FIG. 34, which shown an underside of the container, one or more compartments may include a depression (shown as a protrusion from the underside) to expand the overall capacity of a compartment. In some embodiments, the compartment may have a single depression, although the compartment may have more than one depression. In some embodiments, as shown in FIG. 34, each depression may have a substantially semi hemispherical shape, although the depression may have other suitable shapes. As will be appreciated, in embodiments having more than one depression, the shape and size of each depression may be the same or more may differ.

Figure 26:
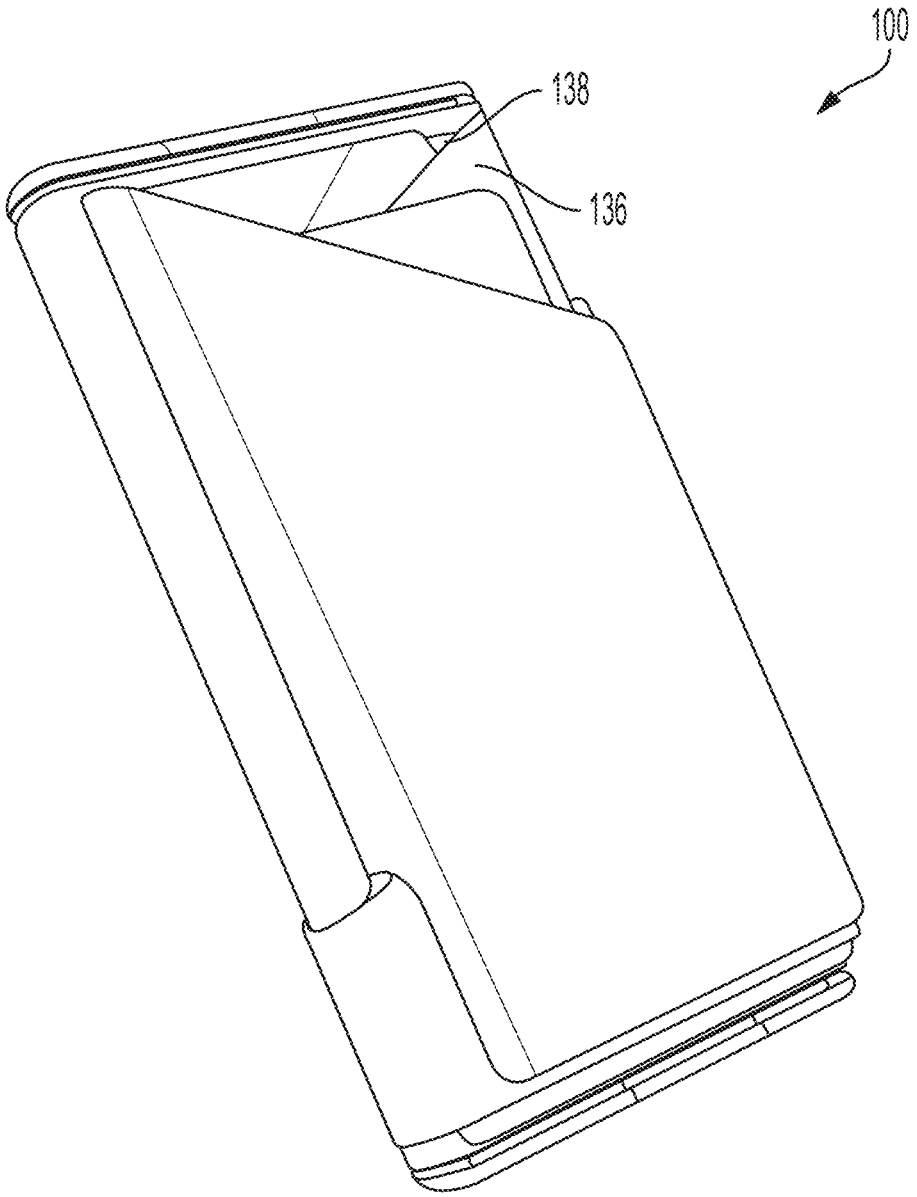
FIG. 26 is a perspective view a container according to some embodiments with a wallet attached thereto.
Figure 27:
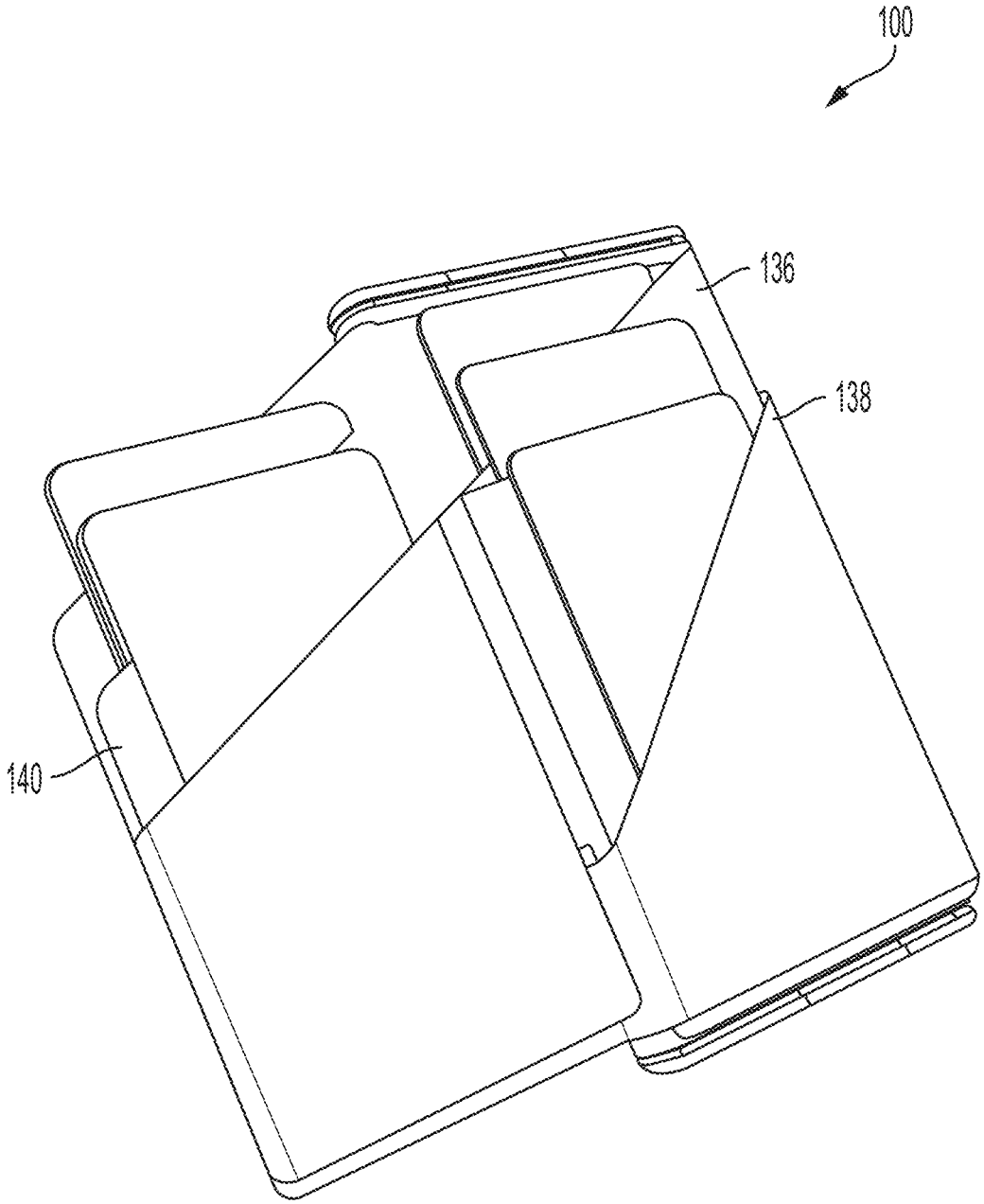
FIG. 27 is the container of FIG. 26, with the wallet of the container shown in an open position.

FIG. 26 illustrates a container which includes a wallet 136 for holding the user's cards and/or money. In some embodiments, the wallet may be attached to a side of the container body opposite the compartments (e.g., on a bottom side). As will be appreciated, the wallet may be permanently attachable to the container, although the wallet also may be removably attachable to the container. For example, the container may include one or more fasteners that engage with corresponding fasteners on the wallet. In some embodiments, the wallet may include one or more slots 138 for receiving credit cards. In some embodiments, as shown in FIG. 27, the wallet may include a card panel 140 that may pivot between an open position and a closed position to allow the user to access more cards and/or money.

Figure 28:
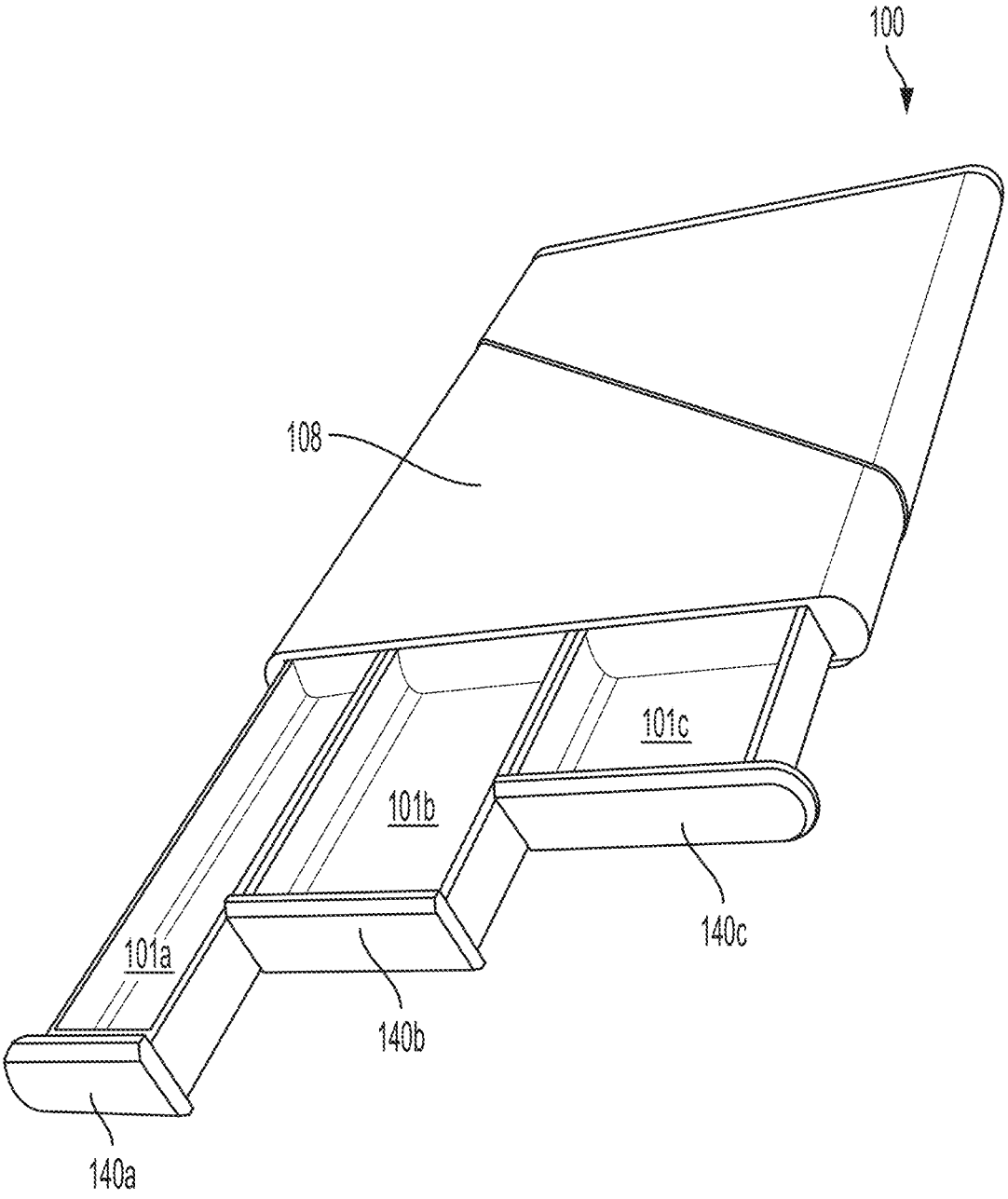
FIG. 28 is a perspective view of a container according to another embodiment.

FIG. 28 illustrates an example of the container according to other embodiments. As shown in this view, the compartments 101*a*-101*c* may be formed in drawers 140*a*-140*c* that slide into and out of the body 108 of the container. In such embodiments, the drawers may form the bottom, front, rear, left, and right sides of the compartment while the container body may form the top of the compartment. As will be appreciated, although three drawers are shown in this embodiment, in other embodiments, the container may have one, two, four, or more drawers and corresponding According to another embodiment, a kit may include a container body, a plurality of removable dividers, and a plurality of covers. In such embodiments, the user may insert the dividers at desired locations (e.g., by snapping the dividers into corresponding receivers on the container body) to form the compartments in the container body. The user may thereafter attach the covers to the container to cover one or more compartments.

In some embodiments, the containers may be configured for specific uses or activities. For example, a first container may be designed for skiing, a second container may be designed for the beach, a third container may be designed for fishing or boating, and a fourth container may be designed for the military. such embodiments, the compartments may be sized to hold personal items corresponding to the particular activity. For example, for containers arranged for fishing, the containers may be sized to hold a bug spray gel, waterproof matches, fishing line, a fishing hook, sunblock, and/or a pain reliever (e.g., Advil). In some embodiments, the containers may be available with the personal items already installed in each of the containers. For example, the pre-loaded containers may be sold at specialty stores, such as at a bait and tackle store. In some embodiments, the user also may use more than one container to store and carry personal items. For example, the user may use a container for personal items to take to work and a second for storing items to take fishing. In such an example, the user may pick and choose which container to carry, or may carry all of the container at the same time, with the containers organized by use.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A container comprising:

a container body having one or more dividers that at least in part define first, second, third, and fourth compartments arranged to hold one or more personal items, wherein the one or more dividers include:

a first longitudinal divider that extends all the way between a front and a rear of the container body;

a second longitudinal divider that extends at least part way between the front and the rear of the container body; and first and second lateral dividers, wherein the first lateral divider extends between a first side of the body and the first longitudinal divider and the second lateral divider extends between the first and second longitudinal dividers; and first, second, third, and fourth covers arranged to cover the first, second, third, and fourth compartments, respectively, wherein a height of the container is less than about 8 mm;

wherein the first cover is attached at and pivots about the front of the container body;

wherein the second cover is attached at and pivots about the rear of the container body;

wherein the first and second covers extend to the first lateral divider; and wherein the first lateral divider includes a depression exposing a portion of the first and second cover for actuating the first and second cover between an open and closed configuration.

2. The container of claim 1, wherein a height of a front side of the container is less than about 5 mm.

3. The container of claim 2, wherein a height of a rear side of the container is less than about 5 mm.

4. The container of claim 1, wherein the first cover forms at least a top portion of the first compartment and a portion of a front of the compartment.

5. The container of claim 1, wherein the one or more dividers extend between a bottom of the container body and a top of the container body.

6. The container of claim 1, wherein the first and second longitudinal dividers extend from the front of the container body to the rear of the container body.

7. The container of claim 1, wherein the first and second lateral dividers are parallel to a lateral axis of the container.

8. The container of claim 1, wherein the one or more dividers are removably attachable to the container body.

9. The container of claim 1, wherein each of the covers includes a front panel and a top panel.

10. The container of claim 9, wherein the top panel extends substantially perpendicular to the front panel.

11. The container of claim 9, wherein a first front panel of the first cover extends over at least a portion of the front of the container body.

12. The container of claim 1, wherein the first cover includes first and second pins.

13. The container of claim 12, wherein the container body includes first and second openings arranged to receive the first and second pins.

14. The container of claim 1, further comprising a wallet attached to the container body.

15. The container of claim 1, wherein the first compartment includes one or more protrusions extending upwardly from a bottom of the compartment.

16. The container of claim 1, wherein a bottom of the first compartment is angled towards a front of the first compartment.

17. The container of claim 1, wherein the first compartment includes a dispenser arranged to dispense at least a portion of a personal item.

18. The container of claim 1, wherein the first and second covers are integrally formed with the first lateral divider.

19. The container of claim 1, wherein the first cover includes a top panel and an engagement member, and wherein a front side of the first compartment includes a corresponding engagement member.

20. The container of claim 1, wherein a height of the container tapers between a central region and at least one of the front and or rear side of the container.

* * * * *